United States Patent [19]

Tachibana

[11] 4,103,521

[45] Aug. 1, 1978

[54] APPARATUS FOR SUCCESSIVELY PROCESSING CONTINUOUS TEXTILE FABRIC

[75] Inventor: Yoshishige Tachibana, Akashi, Japan

[73] Assignee: Toyo Boseki Kabushiki Kaisha, Japan

[21] Appl. No.: 674,070

[22] Filed: Apr. 6, 1976

[30] Foreign Application Priority Data

Dec. 15, 1975 [JP] Japan ..... 50-149868

[51] Int. Cl.[2] ..... D06B 3/10

[52] U.S. Cl. ..... 68/22 R; 68/13 R; 118/6; 118/419; 226/43; 226/50; 226/143

[58] Field of Search ..... 68/22 R, 13 R, 176; 118/6, 419; 34/152; 356/199, 200; 200/61.13, 61.14; 26/21; 226/43, 50, 143

[56] References Cited

U.S. PATENT DOCUMENTS

| | | | |
|---|---|---|---|
| 2,998,175 | 8/1961 | Topping | 226/43 |
| 3,148,816 | 9/1964 | Martin et al. | 226/50 X |
| 3,848,438 | 11/1974 | Tachibana et al. | 68/22 R |
| 3,875,769 | 4/1975 | Inoue | 68/22 R |
| 3,931,722 | 1/1976 | Isoda | 68/176 |
| 3,977,220 | 8/1976 | Clark et al. | 68/22 R |

*Primary Examiner*—Philip R. Coe
*Attorney, Agent, or Firm*—Staas & Halsey

[57] ABSTRACT

A continuous textile fabric comprises a processing chamber containing a processing liquid, a squeeze roll assembly disposed above the processing chamber, and guide rolls disposed on opposite sides of the squeeze roll assembly, the textile fabric in rope-like form being introduced into the processing chamber at one end thereof and successively and spirally set toward the other end of the processing chamber so as to extend around the squeeze roll assembly and guide rolls and through the processing liquid many times and travel as the squeeze roll assembly and guide rolls are rotated. The squeeze roll assembly and guide rolls are adapted to be reversibly rotatable and controlled so that the forward travelling amount of the rope-like textile fabric is greater than the backward travelling amount thereof, the rope-like textile fabric being subjected to impregnation with processing liquid and subsequent squeeze many times while repeating alternate forward and backward movements, and it is gradually advanced an amount corresponding to the difference between the forward and backward travelling amounts for each reciprocating cycle. A device is provided for detecting detectable portions in the leader cloth, and for correcting or regulating the length of portions of the textile fabric included between adjacent nips of the squeeze roll assembly.

48 Claims, 12 Drawing Figures

APPARATUS FOR SUCCESSIVELY PROCESSING CONTINUOUS TEXTILE FABRIC

BACKGROUND OF THE INVENTION

1. Field of the Invention

The present invention relates generally to an apparatus for continuously processing a successively connected textile fabric. More particularly, the present invention relates to an improved continuous processing apparatus adapted to process a continuously connected textile fabric while moving it alternately forwardly and backwardly in such a manner that the forward travelling amount is greater than the backward travelling amount.

2. Description of the Prior Art

A continuous processing apparatus has already been put into practical use which is adapted to process a successively connected textile fabric while moving it alternately forwardly and backwardly in such a manner that the forward travelling amount is greater than the backward travelling amount. In this context, the words "successively connected textile fabric" include woven fabrics, knitted fabrics and the like. In such continuous processing apparatus, a successively connected textile fabric is fed in a rope-like form and subjected to washing, scouring, bleaching, milling or similar treatment in the processing section in the path of travel of the fabric. Rope scouring machines for scouring a successively connected textile fabric in a rope-like form may be classified into two types, the batch type and the continuous type.

An example of the batch type makes use of a wince which is used for dyeing. Thus, a material to be processed which is sewn together at its opposite ends in an endless form is put in the wince and scoured therein while being circulated through the scouring liquid as the wince is rotated. In this case, since the material is simply passed through the scouring liquid, the scouring efficiency is very low, unfit for practical use. Another example of the batch type which utilizes a nipping action is known. At any rate, however, the batch type is very low in productivity and unfit for practical use.

As for the continuous type, an arrangement is known in which a number of washing machines using squeeze rolls to make use of the features of the dyeing wince and nipping action are disposed in series so that a material to be processed is scoured while being continuously moved in one direction. In this case, the productivity is increased as compared with the batch type, but in order to achieve improved washing results (i.e., to effect impregnation with liquid and subsequent squeeze many times), several ten or hundred washing machines are required, and this is not only economically disadvantageous but also requires a large space for installation, thus being unfit for practical use.

SUMMARY OF THE INVENTION

The present invention is directed to an improvement in a continuous processing system adapted to process a successively connected textile fabric while moving it alternately forwardly and backwardly in such a manner that the forward travelling amount is greater than the backward travelling amount.

A principal object of the present invention is to provide an apparatus capable of applying an effective treatment through a smaller number of steps. To this end, according to the present invention, a squeeze roll assembly is reversibly rotatably disposed above and substantially centrally of a processing chamber and guide rolls are also reversibly rotatably disposed on opposite sides of said squeeze roll assembly, while a successively connected textile fabric is spirally set from one end side to the other end side of the processing chamber and is caused to travel alternately forwardly and backwardly so that it is subjected to, for example, impregnation with processing liquid and subsequent squeeze many times and thereby continuously washed.

Another object of the present invention is to prevent a successively connected textile fabric, when being alternately forwardly and backwardly moved, from being damaged or broken owing to its twining around a squeeze roll assembly as it sags, which is otherwise occurrable when the squeeze roll assembly is switched from forward to backward rotation and vice versa since there is an extreme difference between the moisture content of the fabric after squeeze and that immediately before squeeze; for example, in the case of a woolen or worsted fabric, the moisture content after squeeze is 60–70% whereas the moisture content immediately before squeeze is 200–250%; so that the fabric immediately before squeeze is much heavier. To achieve this object, according to the invention, the guide rolls on opposite sides of the squeeze roll assembly are disposed above the level of the nip point of the squeeze roll assembly, and the guide roll disposed on the withdrawing side is positively rotated in its forward or backward rotation phase at such a rate that its surface speed is greater than the surface speed of the squeeze roll assembly, while the other guide roll on the feeding side is negatively rotated.

A further object of the present invention is to prevent the processing liquid from being taken out of the processing chamber, which is otherwise occurrable owing to the forward and backward travel of the fabric, and hence to prevent loss of the processing liquid and resultant instability of the liquid level; and to prevent the movement of the processing liquid, which is otherwise occurrable if the fabric when in a dry state is put directly into the inlet side of the processing chamber when it forwardly travels, and hence to prevent the nonuniform processing of the fabric otherwise caused by said movement. To achieve this object, according to the invention, storage chambers are provided in the textile fabric introducing and delivering sections of the processing chamber, each of said storage chambers storing at least an amount of said fabric corresponding to the forward travelling amount thereof, while a preparatory immersion bath is provided in advance of the storage chamber disposed on the inlet side thereof so that the textile fabric leading to the inlet side storage chamber is wetted in advance in said preparatory immersion bath, said fabric being prevented from being delivered in the backward direction from the inlet side storage chamber, the processed fabric being gradually delivered from the outlet side storage chamber irrespective of the forward or backward travel thereof.

Still another object of the present invention is to prevent kinking, twining around the squeeze roll assembly, and breakage of the textile fabric to prevent resultant damage to and deterioration of the fabric; and to prevent the machine from becoming inoperable; all of which are otherwise occurrable in that when a successively connected textile fabric is moved alternately forwardly and backwardly, the fabric nipped by the squeeze roll assembly often slips and the amounts of such slip at the individual nip points of the squeeze roll assembly differ from each other, so that the prolonged processing of the fabric results in extreme variations in the length of portions of the fabric included between adjacent nips, i.e., the individual loop lengths of the fabric. To achieve this object, according to the invention, a loop length correcting textile fabric having detectable portions spaced apart a predetermined distance therebetween is prepared and, when necessary, the textile fabric being processed is severed on the introduction and delivery sides of the processing chamber, and then sewn at its opposite ends to opposite ends of said correcting textile fabric so as to provide an endless fabric which is then moved within the processing apparatus, during which movement the individual loop lengths are corrected.

These and other objects, features, advantages and aspects of the present invention will be better understood when taken in conjunction with the following detailed description of the preferred embodiments made with reference to the accompanying drawings.

DESCRIPTION OF THE PREFERRED EMBODIMENTS

Figure 1:
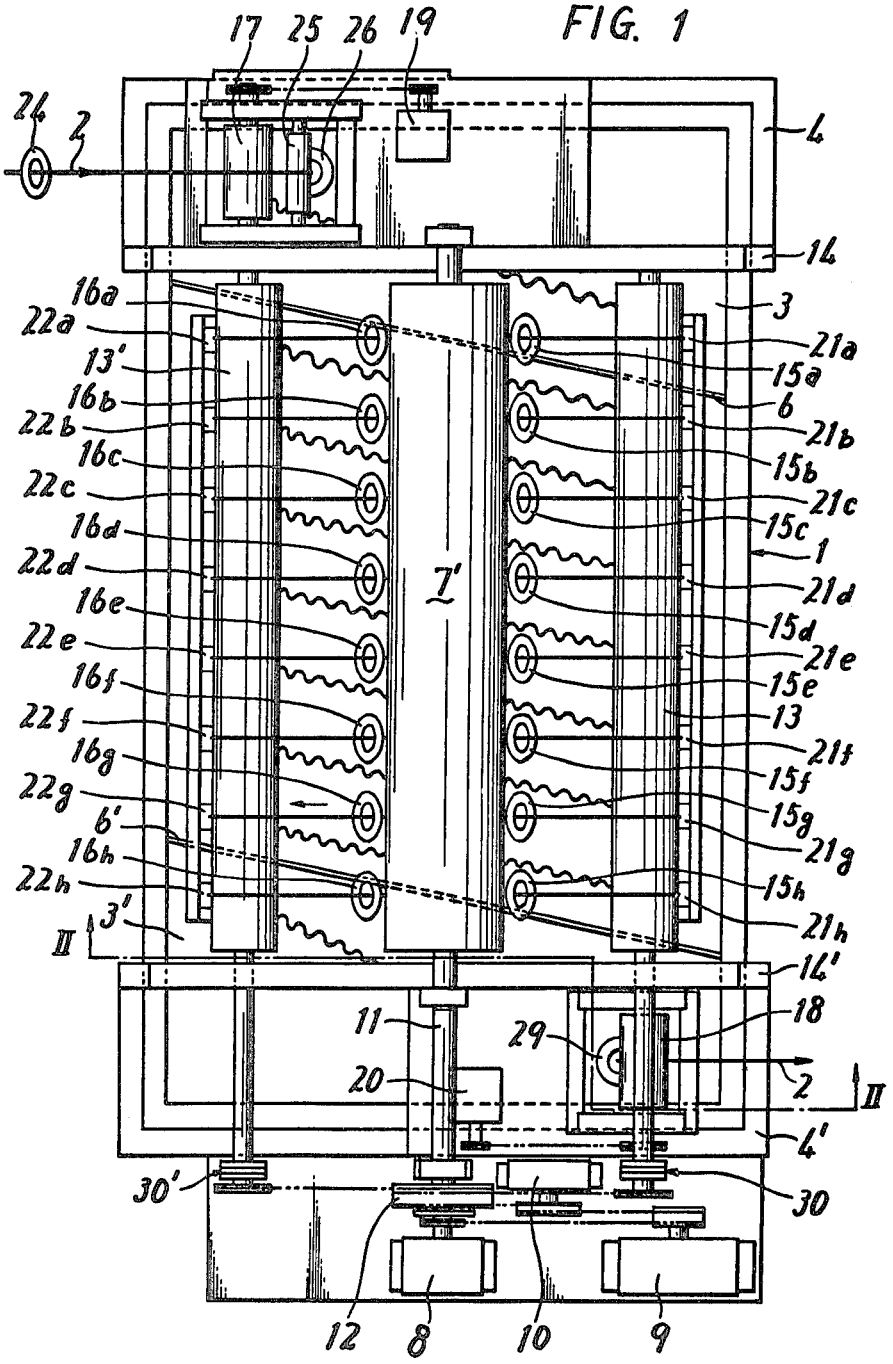
FIG. 1 shows the overall arrangement of a successive processing apparatus for a continuously connected textile fabric in accordance with the present invention.
Figure 2:
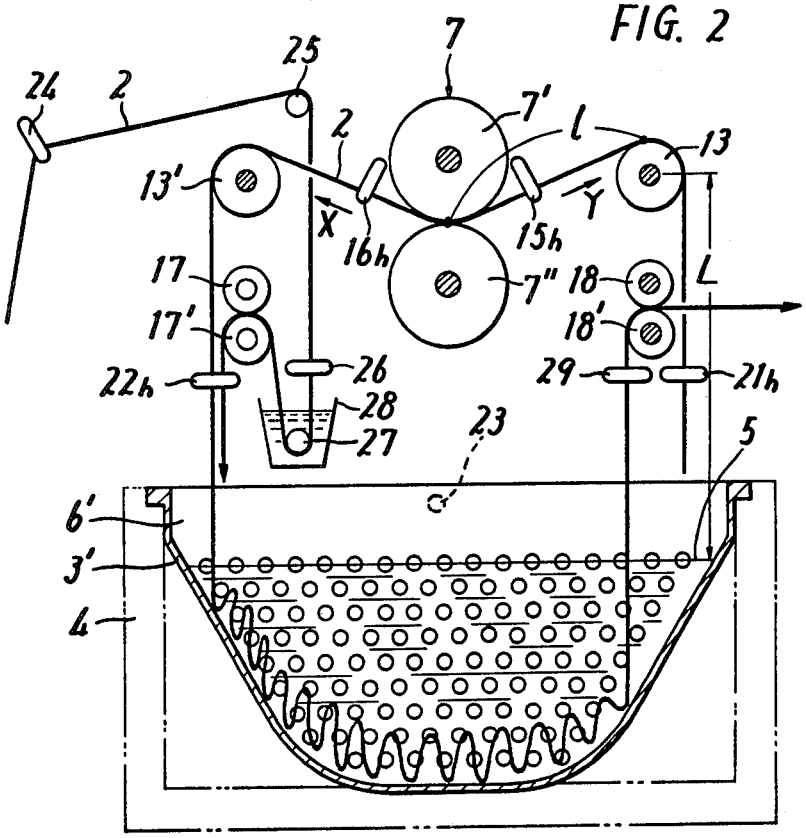
FIG. 2 is a sectional view taken along the line II—II in FIG. 1.

Referring to the drawings, FIG. 1 shows the overall arrangement of a successive processing apparatus for a continuously connected textile fabric, for which the present invention is advantageously employed, and FIG. 2 is a sectional view taken along the line II—II in FIG. 1. The apparatus shown includes a processing chamber 1 containing a processing liquid, and also containing storage chambers 3 and 3' for a material to be processed 2, which is a continuously connected textile fabric, disposed on opposite sides of said processing chamber, these chambers being supported on frames 4 and 4'. The liquid level designated at 5 is maintained the same throughout the three chambers in that partition walls 6 and 6' defining the chambers are perforated. The configuration of the processing chamber is not limited to the one illustrated, but any other suitable configurations may be utilized for the objects of the present invention.

Disposed above the processing chamber 1 is a squeeze roll assembly 7 supported on frames 14 and 14' and consisting of a pair of rolls 7' and 7'', the upper roll 7' being pressed against the lower roll 7'' by press means, not shown. The lower roll 7'' is rotated by a reversibly rotatable driving device 8 through speed reducers 9 and 10 and then through a chain wheel 12 provided on the shaft 11 of the lower roll 7''.

The squeeze roll assembly 7 is arranged so that the amount of feed by forward rotation (in a direction of arrow X shown in FIG. 2 in which the material 2 is forwardly moved) is greater than the amount of feed by backward rotation. In the embodiment, such amount of feed is determined by the number of revolutions of the squeeze roll assembly.

Figure 3:
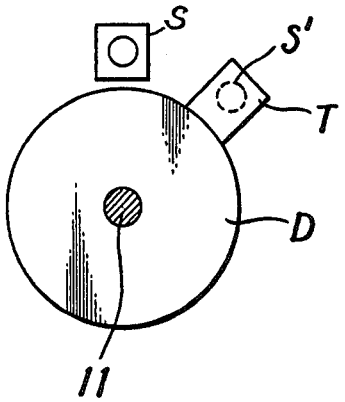
FIG. 3 shows a sensor for detecting the rotation of the shaft of the squeeze roll assembly.

Referring to FIG. 3, the shaft 11 of the lower roll 7'' is concentrically provided with a disc D having a projection T to which an object to be detected S' is attached. Further, a sensor (or a proximity switch) S for detecting said object S' is located in the path of rotation of said object S' so that the latter is detected each time the squeeze roll assembly makes one complete revolution, whereby the number of revolutions is counted. The sensor S may be of a contact type, such as a microswitch, so that count may be made each time the projection comes into proximity of with the sensor. Instead of making use of the number of revolutions of the squeeze roll assembly for determination of the amount of feed, it would be possible to use a timer, but the former is more desirable since, in the latter case, errors or unevenness in action can occur.

Referring back to both FIGS. 1 and 2, disposed forwardly and rearwardly of the squeeze roll assembly 7 and above the level of the nip point thereof are guide rolls 13 and 13' supported on the frames 14 and 14'(FIG. 1). The guide rolls 13 and 13' are rotated reversibly, i.e., forwardly and backwardly, along with the squeeze roll assembly 7 through the chain wheel 12 on the shaft 11 of the lower roll 7''. During the forward rotation of the squeeze roll assembly 7 (i.e., during the forward travel of the material 2), one guide roll 13' (disposed on the left side as viewed in FIG. 2) serves as a withdrawing roll. Thus, the guide roll 13' on the withdrawing side alone is positively rotated at such a rate that its surface speed is greater than that of the squeeze roll assembly 7, while leaving the other guide roll 13 in a free or idle state by interrupting the transmission of the motion thereto from the chain wheel 12 by means of a clutch 30 adapted to be actuated by a control device, not shown, so that the guide roll 13 may be rotated negatively, or concomitantly with the travel of the material 2. The surface speed of the guide roll 13' on the withdrawing side is selected to be 1.03–1.15 times that of the squeeze roll assembly 7, it being found that a more desirable range is 1.05–1.10. During the backward rotation of the squeeze roll assembly 7 (i.e., during the backward travel of the material 2), one guide roll 13' is rendered free by interrupting the transmission of motion thereto from the chain wheel 12 by means of a clutch 30', while the other guide roll 13 serves as a withdrawing roll, being positively driven with its surface speed exceeding that of the squeeze roll assembly 7.

The purpose of positioning the guide rolls 13 and 13' above the level of the nip point of the squeeze roll assembly 7 and rotating the guide rolls 13 and 13' positively or negatively, as described above, is described in the following. Assume, for example, that when the squeeze roll assembly 7 is forwardly rotated, said other roll 13 is positively rotated. Then, since such guide roll is arranged so that its surface speed is greater than that of the squeeze roll assembly, the material 2 would be overfed over the guide roll 13, resulting in the material 2 sagging between the squeeze roll assembly 7 and the guide roll 13 until it twines around the squeeze roll assembly 7, particularly the lower roll 7''. Thus, the purpose is to prevent such phenomnon. Further, the purpose of making the surface speed of the guide roll 13' on the withdrawing side greater than that of the squeeze roll assembly 7 when the latter is forwardly rotating, is to prevent the material 2 from sagging between the guide roll 13' and the squeeze roll assembly 7. In addition, it is desirable that the distance L between the liquid level 5 in the processing chamber 1 and the guide roll 13 or 13' be at least 2.5 times the distance *l* between the nip point of the squeeze roll assembly 7 and the guide roll 13 or 13'. This arrangement allows the material 2 to be pulled under its own weight, whereby the prevention of sagging of the material 2 between the squeeze roll assembly 7 and the guide roll 13 or 13' is further assured. Further, if the material to be processed is of low "weight", the guide rolls 13 and 13' may be smooth rolls as shown, but if materials of high "weight", such as blanket, are to be processed, it is desirable to use fluted rolls or corrugated rolls for the prevention of slip. A slip-preventive material may be wrapped around the rolls as the case may be.

A plurality (8, in the embodiment shown) of annular guides 15*a*–15*h* and 16*a*–16*h* are provided between the squeeze roll assembly 7 and the guide rolls 13 and 13', respectively. The ring guides 15*a*–15*h* and 16*a*–16*h* are made hollow and each provided with a number of small holes through which a processing liquid is spouted against the material 2 passing through the ring guides in order to improve the condensability of the material and hence to provide for a better squeezing effect. It is so arranged that when the material is moved in the direction of arrow X shown in FIG. 2 by the forward rotation of the squeeze roll assembly 7, the right-hand side ring guides 15*a*–15*h* alone spout the processing liquid, and that when the material is moved to the right, the left-hand side ring guides 16*a*–16*h* alone spout the processing liquid. The purpose of this arrangement is described as in the following. For example, if the left-hand side ring guides 16*a*–16*h* spout the processing liquid when the material 2 is moving in the direction of arrow X, the material would be subjected to a resistance as it passes through said ring guides, resulting in the material sagging between the ring guides 16*a*–16*h* and the squeeze roll assembly 7 until it twines around the squeeze roll assembly 7. Thus, the purpose is to prevent such phenomenon.

The apparatus shown further includes feed rolls 17 and 17' for the material 2 disposed above one storage chamber 3 and delivery rolls 18 and 18' disposed above the other storage chamber 3'. The feed and delivery rolls are rotated in one direction by motors 19 and 20, respectively, at such a rate that their surface speed is lower than that of the squeeze roll assembly 7.

The apparatus shown further includes lattice-shaped guides 21*a*–21*h* and 22*a*–22*h* disposed below said guide rolls 13 and 13' respectively, and formed with guide openings through which the material is passed. If, therefore, the material becomes entangled to form a kink before it passes through any of said guide openings, the lattice-shaped guide assembly is lifted by such kink, thereby actuating a detector, not shown, to bring the apparatus to a stop.

A feeler 23 for detecting the material is provided, which, when the portion of the material received in the processing chamber becomes extremely short in length owing to slip, is adapted to be pushed up by said portion, thereby bringing the apparatus to a stop through a detector, not shown.

The apparatus shown further includes guides 24, 25, 26 and 27 disposed on the feed side and a guide 29 disposed on the delivery side. The material 2 to be processed, which is a continuously connected textile fabric, is introduced into the processing apparatus structured in the manner described above, where it is processed.

Preparatory to the processing, the material is spirally set over and in the processing chamber 1 so as to pass through the squeeze roll assembly 7 over the guide rolls 13 and 13' and through the processing liquid, while at least an amount of material 2 corresponding to the amount of feed by forward rotation of the squeeze roll assembly 7, i.e., at least the same amount of material 2 as the forward travelling amount of material 2, is stored in each of the storage chambers 3 and 3'.

In this condition, the squeeze roll assembly 7 is rotated forwardly and backwardly by turns to move the material 2 forwardly and backwardly by turns. Eventually, the material 2 is gradually advanced each time by an amount corresponding to the difference between the forward and backward travelling amounts thereof, while the processed portions of the material are stored in the storage chamber 3', from which the preceding processed portions are gradually taken out through the delivery rolls 18 and 18'. The same amount of material as the amount delivered through the delivery rolls 18 and 18' is, of course, fed into the storage chamber 3 on the inlet side by the feed rolls 17 and 17' via the guides 24, 25 and 26 and an immersion bath 28.

Figure 4A:
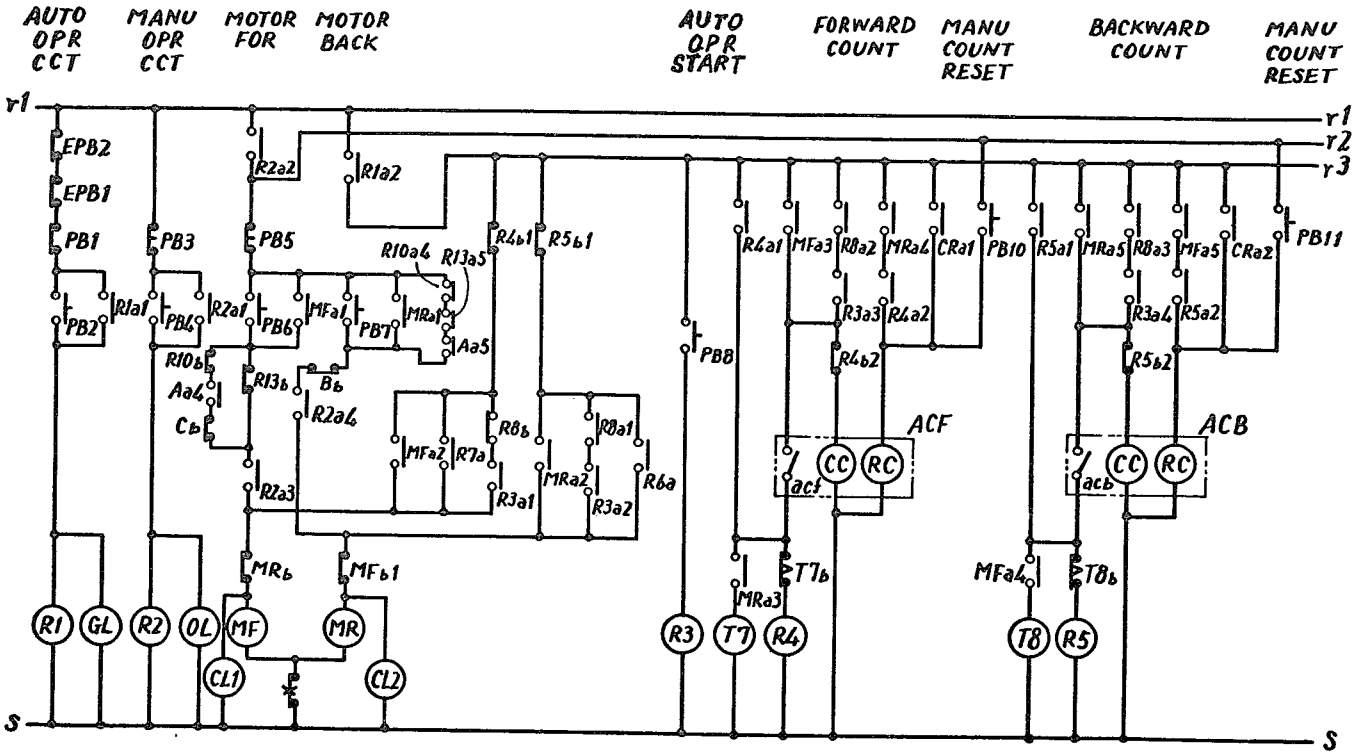
FIGS. 4*a* and 4*b* show a schematic diagram of a control circuit for controlling the forward and backward rotation of the squeeze role assembly.
Figure 4B:
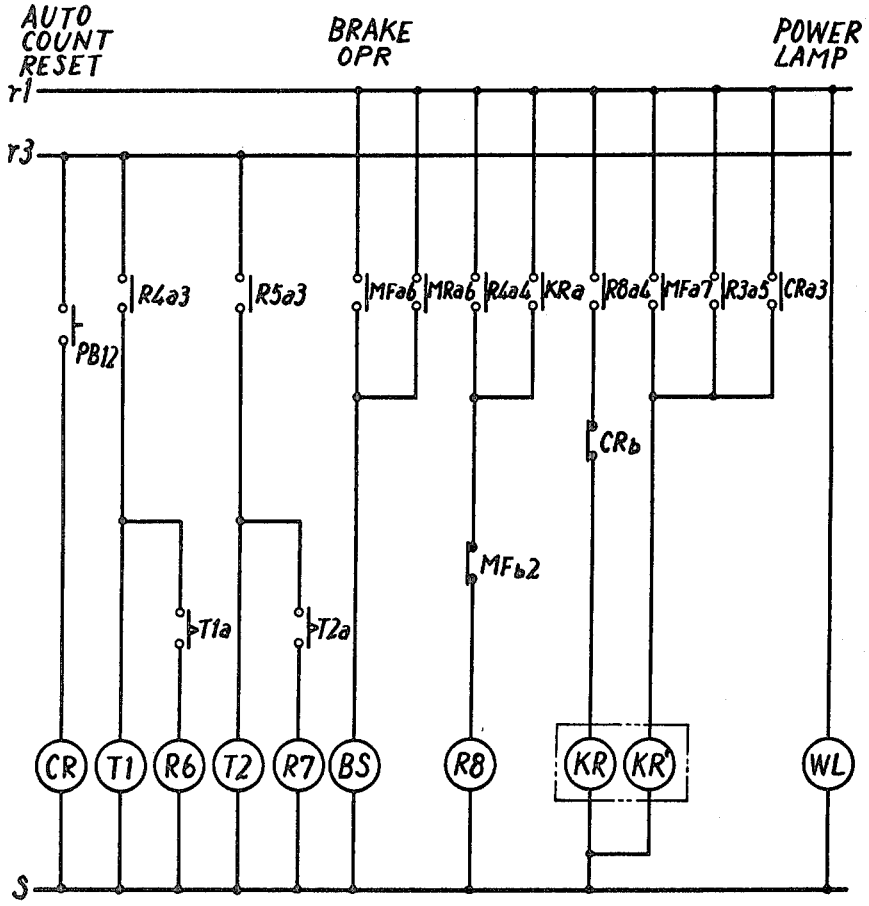

The control of such forward and backward rotation of the squeeze roll assembly, i.e., the control of the forward and backward travel of the material to be processed is accomplished by a control circuit shown in FIGS. 4A and 4B.

The forward and backward rotating operation of the squeeze rolls, and thus the forward and backward control of the material is effected by a control circuit shown in FIGS. 4A and 4B, which comprises various switches, contacts and relays connected between buses r1, r2 and r3 and S in the manner shown. Referring to FIG. 4A, when a start button PB2 is depressed, a relay R1 of an automatic operation circuit is energized, and accordingly an a contact, R1a1 of the relay R1 is turned on, whereby the on state of the relay R1 is self-retained. At the same time an "*a*" contact R1a2 of the relay R1 is also turned on. Next, a push button PB8 for the automatic operation start is depressed, so that the relay R3 is energized, and accordingly the "*a*" contacts R3a1 through R3a5 are turned on. Turning on of the a contact R3a1 causes a magnet switch MF for motor forward rotation to be energized, whereby the motor 8 and thus the squeeze roll assembly 7 (FIGS. 1 and 2) are driven to be forward rotated. At the same time as energization of the magnet switch MF, a relay CL1 of clutch 30' for the guide roll 13' (FIG. 1) is also energized, whereby only one side guide roll 13' out of the guide rolls 13 and 13' is positively rotated. As a result, the material 2 is fed in the forward direction (in the direction of arrows X as seen in FIG. 2). At that time, energization of the magnet switch MF causes the "b" contact MFb1 thereof to turn off, thereby to insure that the operation of the magnet switch MR for motor backward rotation is prevented.

Energization of the magnet switch MF causes the "a" contact MFa2 thereof to be turned on, whereby the magnet switch MF is self-retained, when the "a" contacts MFa1, MFa3 through MFa7 are also turned on and the "b" contact MFb2 is turned off. It is pointed out that the a contact MFa1 is a "a" contact of a manual circuit. The turning on of the contact MFa3 causes a count coil CC of a forward counter ACF to be energized, whereby the number of rotations of the squeeze rolls 7 and 7' in the forward direction is counted using the detecing output from the switch shown in FIG. 3.

Turning on of the "a" contact MFa6 (FIG. 4B) causes a brake switch BS of the motor to be energized, whereby the brake (not shown) is disengaged. If and when the number of forward rotations of the motor reaches a preset number in the counter ACF, a switch acf is turned on, whereby a relay R4 for stopping the forward rotation is energized.

Energization of the relay R4 causes the "b" contact R4b1 to be turned off, whereby the magnet switch MF for motor forward rotation is deenergized to deenergize the motor 8 and thus to stop the forward rotation of the squeeze rolls, when the "a" contact MFa6 (FIG. 4B) of the magnet switch MF is turned off, whereby the brake switch BS is deenergized, thereby to engage the brake (not shown). On the other hand, the "b" contact R4b2 is turned off, whereby the forward rotation count coil CC is deenergized. At the same time, the a contact R4a1 of the relay R4 is turned on, whereby the relay R4 is self-retained, while the "a" contacts R4a2 through R4a4 thereof are also turned on.

Turning on of the "a" contact R4a3 causes a timer T1 for delay of backward rotation command to be energized, so that the a contact T1a is turned on after the lapse of a predetermined delay time, whereby a relay R6 for backward rotation command is energized. Energization of the relay R6a causes the "a" contact R6 to be turned on, whereby a magnet switch MR for backward rotation of the motor 8 is energized through the "b" contact MFb1 of the magnet switch MF being closed at that time, with the result that the motor 8 and thus the squeeze roll assembly are backward driven. At the same time as energization of the magnet switch MR, a relay CL2 of the clutch 30 for the guide roll 13 (FIGS. 1 and 2) is also energized, whereby only one side guide roll 13 out of the guide rolls 13 and 13' is positively rotated, with the result that the material 2 is fed in the backward direction (the direction of arrow X as seen in FIG. 2). Since the magnet switch MR is energized, the "b" contact MRb thereof is turned off, thereby to insure that the operation of the magnet switch MF for motor forward rotation is prevented.

Energization of the magnet switch MR causes the "a" contact MRa2 thereof to be turned on, whereby the magnet switch MR is self-retained, while the "a" contacts MRa1 and MRa3 through MRa6 thereof are also turned on. It is pointed out that the "a" contact MRa1 is a contact of a manual circuit. Since the "a" contact MRa4 is turned on, a reset coil RC of the counter ACF for forward rotation is energized through the "a" contact MRa4 of the magnet switch MR and the "a" contact R4a2 of the relay R4, whereby the counter ACF is reset.

When the "a" contact MRa5 of the magnet switch MR is turned on, the count coil CC of a counter ACB for backward rotation is energized, whereby the number of backward drive rotations is counted. The preset number in the forward rotation counter ACF is selected to be larger than the preset number in the backward rotation counter ACB.

Since the "a" contact MRa3 of the magnet switch MR has been turned on, a timer T7 is energized through the closed "a" contact MRa3 of the magnet switch MR and the "a" contact R4a1 of the relay R4, whereby the b contact T7b of the timer T7 is turned off and thus the relay R4 is deenergized after the lapse of the delay time of the timer T7. Since the "a" contact MRa6 (FIG. 4B) of the magnet switch MR is turned on, the brake switch BS is also energized, whereby the brake is disengaged.

If and when the number of backward rotations of the motor 8 (FIG. 1) reaches the preset number in the counter ACB, the switch acb of the counter ACB is turned on, whereby the relay R5 for stopping the backward rotation is energized. Energization of the relay R5 causes the "b" contact R5b1 to be turned off, whereby the magnet switch MR for backward rotation of the motor 8 is deenergized, with the result that the backward drive of the motor 8 and thus of the squeeze rolls is stopped, when the "a" contact MRa6 of the magnet switch MR is turned on and thus the brake switch BS is turned off (FIG. 4B), thereby to engage the brake (not shown). Since the "b" contact R5b2 of the relay R5 is turned off, the count coil CC for backward rotation is deenergized. At the same time, the "a" contact R5a1 of the relay R5 is turned on, whereby the relay R5 is self-retained, while the "a" contacts R5a2 and R5a3 of the relay R5 are also turned on. Turning on of the "a" contact R5a3 of the relay R5 causes a timer T2 for delay of forward rotation command to be energized, whereby the "a" contact T2a of the timer T2 is turned on and thus the relay R7 for forward rotation command is also energized after the lapse of the delay time of the timer T2.

Energization of the relay R7 causes the "a" contact R7a to be turned on, whereby the magnet switch MF for motor forward rotation is turned on through the closed "b" contact R4bl of the relay R4 and the "b" contact MRb of the magnet switch MR, with the result that the forward rotation of the motor 8 and thus of the squeeze rolls is regained. The relay R5 for stopping the backward rotation is deenergized, if and when the "b" contact T8b is turned off after the delay time of the timer T8 since the timer T8 is turned on through the closed a contact MFa4 as a result of energization of the magnet switch MF and through the closed "a" contact R5al of the relay R5.

Thereafter the above described operation is repeated to successively process the material, while the material is transferred in turn in the forward direction by the difference between the feeding amounts of the material in the forward and backward rotations of the motor 8 and thus of the squeeze roll assembly 7.

It is pointed out that the FIGS. 4A and 4B circuit is shown comprising a push button PB1 for stoppage, push buttons EPB1 and EPB2 for emergency stoppage, a start push button PB4 of the manual operation circuit, a relay R2 for the manual operation circuit comprising the "*a*" contacts R2a1 through R2a4, a push button PB3 for stoppage, push buttons PB6 and PB7 for forward drive and rearward drive, respectively, of the motor 8, a push button PB5 for stoppage, a push buttons PB10 and PB11 for resetting the counter in the manual operation circuit, a relay CR comprising the "*a*" contacts CRa1 through CRa3 and the "*b*" contact CRb, display lamps GL, OL and WL. The FIGS. 4A and 4B circuit is shown further comprising relays R8 and KR each serving to function as a keep relay for keeping the driving direction if and when the machine is emergnecy stopped by occurrence of power failure during the forward or backward driving or unforeseeable troubles. These relays serve to maintain in a normal condition the relation between the feeding amount in the forward direction and the feeding amount in the backward direction when the machine starts again to operate, therby to achieve the operation in accordance with the predetermined program. By way of an example, let it be assumed that in the course of processing, in accordance with the program for the number of forward drives being 60 and the number of backward drives being 50, power failure occurs at the number of backward drives of 29. Since the relay KR remains on until the subsequent start of operation, the operation of the machine starts in the backward direction when the power is recovered and the machine starts to operate. Thus the count proceeds as 30, 31, . . . 50, whereupon the direction of drive is changed to the opposite direction i.e. to the forward direction. Thus it is appreciated that when power is recovered after the power failure, the relay KR is energized and thus the relay R8 is energized as a result of closing of the "*a*" contact KRa of the relay KR, whereupon the push button PB2 is depressed so that the relay R1 is energized. Thereafter the push button PB8 is depressed so that the relay R3 is energized, with the result that the magnet switch MR is energized, i.e. the operation is restarted from the backward direction, in the above described example.

As described above, with the apparatus shown in FIG. 1 and 2, the material 2 undergoes an effective treatment through a smaller number of steps. In such apparatus, however, the material to be processed nipped by the squeeze roll assembly 7 often slips during its travel and the amounts of slip at the individual nip points differ from each other. As a result, a prolonged processing of the material would cause the distance between adjacent nip points on the material to vary to the extent of bringing about an undesirable situation. The length of a portion of the material set between adjacent nip points will be hereinafter referred to as "loop length" in view of the fact that said portion forms an approximate loop. Accordingly, the present invention is also intended to correct or regulate the individual loop lengths before an extreme variation in such loop length takes place. Improvements in this respect will now be described with reference to FIGS. 5 through 11.

Figure 5:
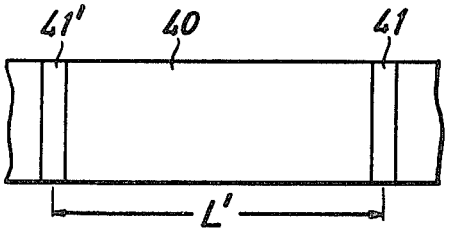
FIG. 5 schematically shows a loop length correcting cloth used for correcting the loop lengths of the material to be processed.

FIG. 5 schematically shows a loop length correcting cloth 40 (hereinafter referred to as "leader cloth") used for embodying the present invention. The leader cloth 40 is provided in advance with two detectable portions 41 and 41' spaced apart a predetermined distance L' corresponding to a predetermined loop length of the material. To form the detectable portions 41 and 41', metalic foils, metalic yarns, fluorescent-dyed yarns, metal netting and the like may be used, but in the embodiment, aluminum foils are placed on the leader cloth 40 across the cloth, or copper wire rings are, arranged on the leader cloth 40 at the opposite ends in successively mutually displaced relation across the cloth, and another cloth is then placed thereover, the resulting sandwich being machine-sewn.

Figure 6:
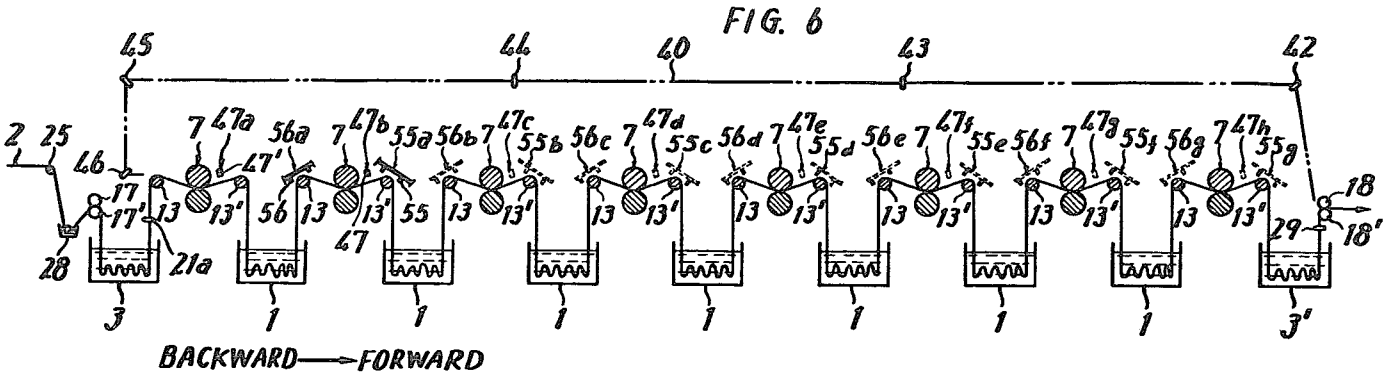
FIG. 6 is a view of the apparatus of FIGS. 1 and 2, shown developed with respect to the material being processed for the convenience of explanation, provided with loop length regulating means, only the leader cloth being shown extended in a phantom manner.

FIG. 6 is a view of the apparatus of FIGS. 1 and 2, shown developed with respect to the material being processed for the convenience of explanation, provided with loop length regulating means according to the present invention, only the leader cloth being shown extended in a phantom manner. As shown in FIG. 6, the leader cloth 40 is set around guides 42, 43, 44, 45 and 46 disposed above the processing chamber 1. It is to be noted that when it is desired to correct loop lengths, the leader cloth is joined to the ends of the material severed on the introduction and delivery sides of the processing chamber 1, so as to form an endless loop.

Figure 8:
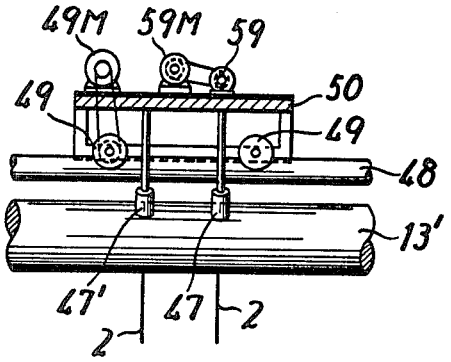
FIG. 8 is a sectional view taken along the line VIII—VIII in FIG. 7.

There are provided detectors 47 and 47' for detection of the detectable portions 41 and 41' attached to the ends of the leader cloth 40, two such detectors being disposed in the path of travel of the material 2 (in the illustrated example, between the squeeze roll assembly 7 and the guide roll 13') spaced apart the same distance as the distance between adjacent loops of the material 2 as spirally set around the rolls 13', 7 and 13, as seen in FIG. 8 to be described subsequently.

Figure 7:
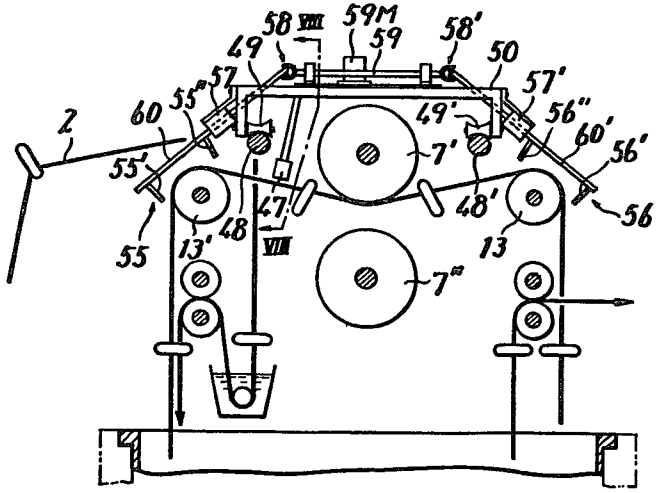
FIG. 7 shows a sectional view of the principal arrangement of loop length correcting means used in the present invention.

Referring to FIG. 7, there is shown in a sectional view the principal arrangement of loop length correcting means used in the present invention. FIG. 8 is a section taken along the line VIII—VIII in FIG. 7. As shown in FIGS. 7 and 8, the detectors 47 and 47' are attached to a carriage 50 with wheels 49 and 49' mounted on rails 48 and 48' installed above the processing chamber 1, which rails are implemented in the embodiment by stays mounted on the machine frame, so that as the carriage 50 travels the detectors 47 and 47' are moved axially of the squeeze roll assembly 7. To this end, the wheel 49 is adapted to be driven for rotation by a motor 49M fixed on the top of the carriage 50. In FIG. 6, the respective positions assumed by the detector 47 with respect to the squeeze roll assembly 7 as the detector 47 is moved, are designated at 47*a*–47*h*.

The detectors 47 and 47' are proximity switches of the eddy current type in the case where the detectable portions 41 and 41' are in the form of metallic foils; they are those of the iron detection type in the case where the detectable portions are in the form of metallic yarns of metallic netting; and they are those of the fluorescence detection type in the case where the detectable portions are in the form of fluorescent-dyed yarns. In the embodiment, proximity switches are used, the arrangement being such that when either of the detectors 47 and 47' is actuated, the machine is brought to a stop. Alternatively, the detectors 47 and 47' may be attached to another position, for example, below the guide rolls.

Referring to FIGS. 6 and 7, the machine shown includes two-finger fork shaped stoppers 55 and 56 for stopping, by taking up the material, the travel of the corresponding portion of the material when the detectable portion 41 is detected by the detector 47 in the loop length correcting mode. The detail of the structure and operation of the stoppers will be later described. The stoppers are disposed in the path of travel of the material 2 (in the illustrated example, above the guide rolls 13 and 13').

Figure 9:
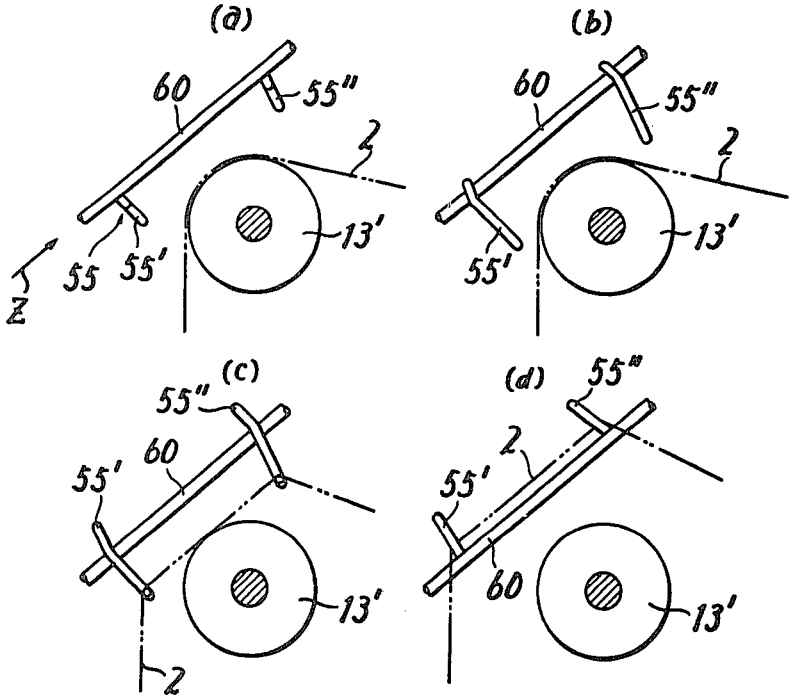
FIGS. 9 and 10 illustrate the successive steps of operation of the stoppers, FIG. 9 showing only one of the stoppers and FIG. 10 showing a view taken in the direction of arrow Z in FIG. 9.
Figure 10:
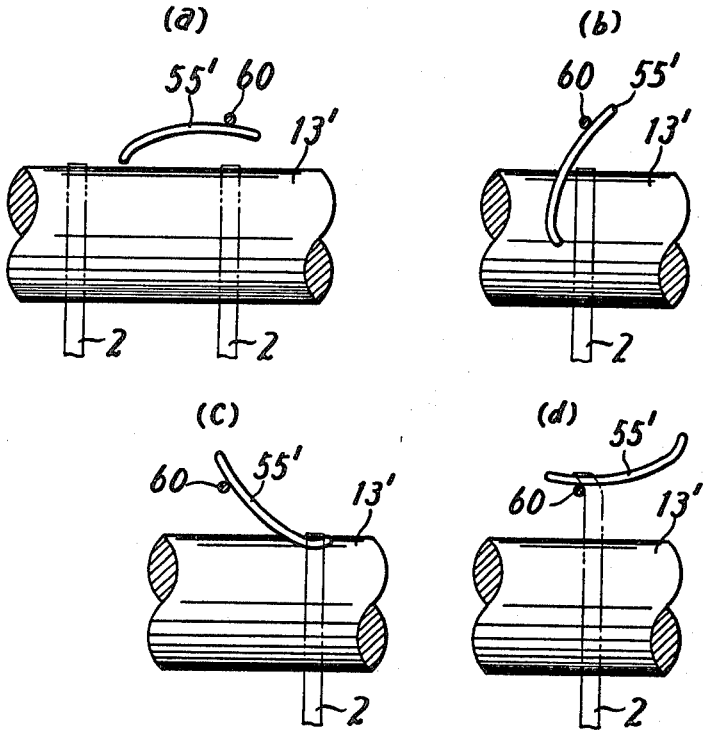

The successive steps of operation of the stoppers 55 and 56 are illustrated in FIGS. 9 and 10. FIGS. 9 and 10 show one stopper 55 only, FIG. 10 being a view taken in the direction of arrow Z in FIG. 9. Referring to FIGS. 7, 9 and 10, two-finger fork shaped stoppers 55 and 56 are constituted of pairs of fingers or hooks 55', 55'' and 56', 56'', respectively, each pair being spaced apart a distance greater than the diameter of the guide rolls 13 and 13', the arrangement being such that in the loop length correcting operation mode, said hooks are rotated by rotatable means to be later described so as to take up and catch the corresponding portion of the material 2 and pull it apart from the guide rollers 13 and 13' (see FIGS. 9 and 10), thereby selectively stopping the travel of only the corresponding portion of the material.

Referring to FIG. 7, the stoppers 55 and 56 are fixed to shafts 60 and 60', respectively, which extend through bearings 57 and 57' attached to the carriage 50 toward a position above the rolls 13' and 13, respectively, and which are connected through universal joints 58 and 58' to a shaft 59 disposed over the carriage 50. Referring to FIGS. 7 and 8, the shaft 59 is adapted to be driven for rotation by a motor 59M fixed on the carriage 50. As the carriage 50 travels, the stoppers 55 and 56 are moved along with the detectors 47 and 47' axially of the squeeze roll assembly 7. Referring to FIG. 6, the positions assumed by the stoppers 55 and 56 with respect to the corresponding regions of the squeeze roll assembly 7 during the movement of said stoppers are designated at 55*a*–55*g* and 56*a*–56*g*. The shafts 60 and 60' to which the stoppers 55 and 56 are fixed, respectively, are each disposed substantially parallel to the chord subtending the arc on the associated guide roll 13 or 13' over which the material 2 is in contact with such guide roll when the upper roll 7' of the squeeze roll assembly 7 is lifted, and desirably, the shafts 60 and 60' are disposed at right angles with the axis of the squeeze roll assembly 7 so that they may be aligned with one detector 47.

It is to be pointed out that the hooks used as the stoppers 55 and 56 are not limited in configuration and in number to what is illustrated. Further, it is to be pointed out that while the hooks have been described in the illustrated example as automatically rotated by the motor 59M, the shafts 60 and 60' may be provided with handles for manually rotating the hooks. While the illustrated example has an arrangement in which the hooks are rotatable for the purpose of automatically achieving the travel stop action of the material, such hooks may be fixed to the carriage 50 so that the material may be brought into engagement therewith by hand. Further, the hooks serving as said stoppers may be replaced by grippers to pull the material apart from the guide rolls 13 and 13'. Such grippers may be disposed between the squeeze roll assembly 7 and the guide rolls 13 and 13' so as to grip the material, thereby stopping the travel of the material without pulling it apart from the guide rolls 13 and 13'. Further, in the illustrated example, the stoppers 55 and 56 and the detectors 47 and 47' are adapted to be moved as a unit, but they may be designed to be separately movable, and any suitable means for moving them may be employed and it is possible to move them automatically.

The loop length correction is performed by a control circuit whose electrical operation will be later described. Accordingly, the mechanical operation for loop length correction will now be described. When it is desired to correct loop lengths, with the machine brought to a stop in advance, the material 2 is severed on the introduction and delivery sides of the processing chamber 1 and the ends of the severed material are connected to the leader cloth 40 having detectable portions 41 and 41' at both ends so as to form a large endless loop, while with the upper roll 7' of the squeeze assembly 7 maintained in its lifted position (see FIG. 7), the detectors 47 and 47' are placed at the positions 47*a* and 47*b* and the stoppers 55 and 56 are placed at the positions 55*a* and 56*a* as an initial condition. Now, assume that the loop lengths after treatment, i.e., in the illustrated example (the "loop lengths" of the material extending between adjacent detector positions, as specifically defined previously) are 25*m*, 45*m*, 25*m*, 25*m*, 45*m*, 25*m* and 25*m*, respectively, in the order beginning at the inlet side and that the preselected distance L' between the detectable portions 41 and 41' is 35*m*, which means that the prescribed loop length is 35*m*.

Under these conditions, the guide roll 13' on the withdrawing side causes the material 2 to travel, and with reference to FIG. 6, i.e., the material travels in the forward direction, and during this travel the leading one 41' of the detectable portions passes by the detector 47 located at the position 47*a*, whereupon the detectors 47 and 47' are rendered in an operable or active condition. Even in this condition, the material continues travelling, and since the first loop length is shorter than the prescribed loop length, the leading detectable portion 41 reaches the detector 47 located at the position 47*b* earlier than the trailing detectable portion 41' reaches the detector 47' located at the position 47*a*. In response to the detection by said detector 47, the machine is stopped and hence the travel of the material is stopped. Thereupon, the stoppers 55 and 56 are driven in the manner shown in FIGS. 9 and 10 to take up or pull the corresponsing portion of the material apart from the guide rolls 13 and 13'.

A machine start switch (not shown) is pushed, whereby the machine is started again and thus the guide roll 13' causes the material to travel. However, the portion of the material caught by the stoppers 55 and 56 is maintained at rest. When the trailing detectable portion 41' reaches the detector 47' located at the position 47*a* and is thereby detected, the machine is stopped again and hence the travel of the material is stopped. Now it follows that the regulation or correction of the first loop length corresponding to the leader cloth 40 has been completed.

Upon completion of correction of the first loop length, the stoppers 55 and 56 are driven in the direction opposite to the previous one so as to bring the material back to its original state where it is set around the guide rolls 13 and 13', while the detectors 47 and 47' are moved to the positions 47*c* and 47*b*, respectively, and the stoppers 55 and 56 are moved to the positions 55*b* and 56*b*, respectively.

The machine is driven again to perform the second loop length correction. In this case, however, since the second loop length is longer than the prescribed length, the trailing detectable portion 41' reaches the detector 47' located at the position 47*b* earlier than the leading detectable portion 41 reaches the detector 47 located at the position 47*c*. In response to the detection by the detector 47', the machine is stopped and hence the travel of the material is stopped. In this case, however, without actuating the stoppers 55 and 56, the machine is driven again until the leading portion 41 reaches the detector 47 located at the position 47*c*, whereupon the machine is stopped and hence the travel of the material is stopped, whereupon the stoppers 55 and 56 are actuated to pull the corresponding portion of the material apart from the guide rolls 13 and 13' to maintain said portion at rest.

The machine is then driven in the direction opposite to the preceding one, i.e. it is driven in the backward direction. In this case, the guide roll 13 is positively driven, by which the material is caused to travel in the backward direction. When the trailing detectable portion 41' reaches the detector 47' located at the position 47*b*, the machine is stopped in response to the detection by the detector 47', thereby stopping the travel of the material. The correction of the second loop length has thus been completed. The stoppers 55 and 56 are then operated in the direction opposite to the preceding one so as to bring the material to its original state.

The correction of the subsequent loop lengths is similarly performed, and when all the loop lengths are corrected, the guide rolls 13 and 13' are stopped, the detectors 47 and 47' are rendered in an unoperable or inactive state and the squeeze roll assembly 7 is brought to its original position.

Figure 11:
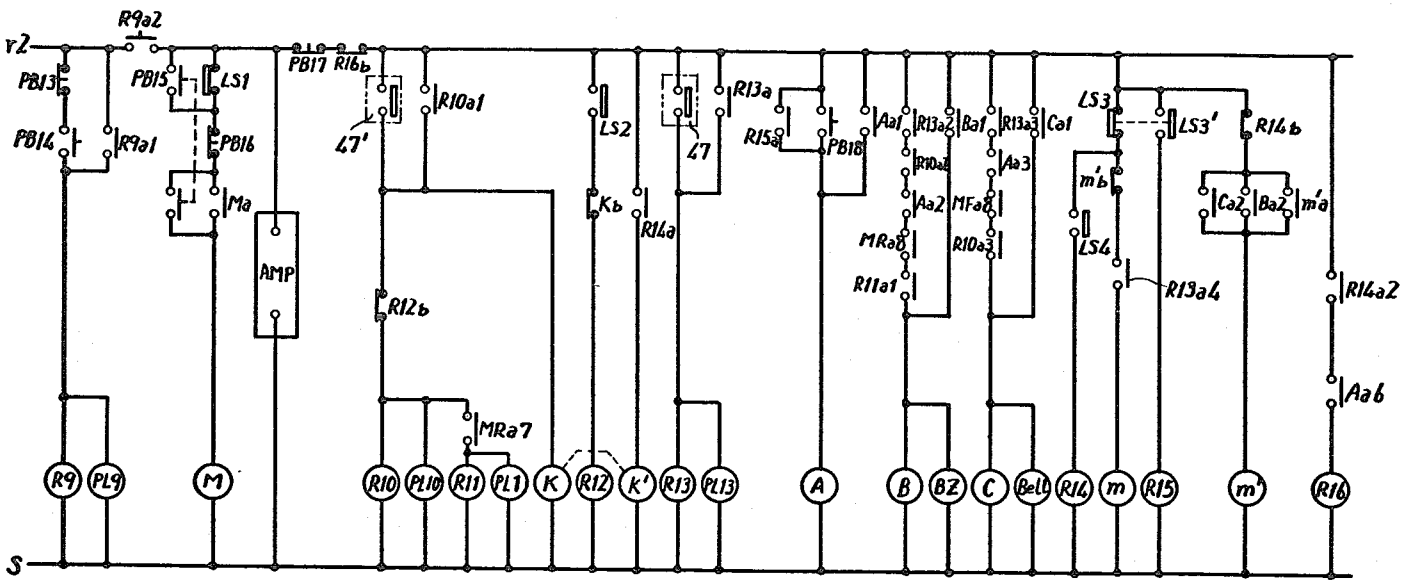
FIG. 11 is a schematic diagram of a loop length correcting circuit for controlling the operation of the loop length correcting apparatus shown in FIGS. 7 through 10.

FIG. 11 is a schematic diagram of a loop length correcting circuit for controlling the operation of the loop length correcting apparatus shown in FIGS. 7 through 10. The FIG. 11 circuit comprises various switches, contacts and relays connected between buses r2 and S in the manner shown. Referring to FIG. 11, operation of the loop length correcting circuit will be described in the following. In preparation for the loop length correcting operation mode, both ends of the material 2 to be processed are connected through the leader cloth 40 to form a large endless loop, as previously described. The upper roll 7' of the squeeze roll assembly 7 is raised and the detectors 47 and 47' are positioned to the positions 47*b* and 47*a*, respectively (see FIG. 6). For the purpose of describing the operation of the FIG. 11 circuit, let it be assumed that the first loop length is shorter than the predetermined length of the leader cloth 40 and the second loop length is longer than the predetermined length of the leader cloth 40.

For the purpose of starting the operation of the machine, the push button PB4 for manual operation is depressed (see FIG. 4A), whereby the relay R2 is energized and accordingly a contact R2al is turned on, thereby to self-retain the relay R2, while a contacts thereof R2a2 and R2a3 are also turned on. Referring to FIG. 11, then a push button PB14 of the loop length correcting circuit is depressed to be turned on, whereby a relay R9 is energized and accordingly the "*a*" contact R9al is turned on to self-retain to relay R9, while the "*a*" contact R9a2 is also turned on. By way of an initial condition, it is assumed that a limit switch LS2 has been turned on as a result of depression by the carriage 50 being in the initial or home position and accordingly a relay R12 has also been energized, so that the "*b*" contact R12b has been turned off. It is pointed out that the limit switch LS2 is turned off, when the carriage 50 moves thereby to release depression of the limit switch LS2.

Then a push button PB6 is depressed (see FIG. 4A), whereby the magnet switch MF is energized and the motor 8 (see FIG. 1) is driven for rotation in the forward direction. If and when the leading detectable portion 41 of the leader material 40 comes to pass the position of the first detector 47' as positioned in the position 47*a* in FIG. 6, a relay R10 is not energized because the "*b*" contact R12b of the relay R12 has been turned off, when a keep relay K is energized and accordingly the "b" contact Kb thereof is turned off, so that a relay R12 is deenergized and accordingly the "*b*" contact R12b thereof is turned on, thereby to insure that the leading detectable portion is not detected only for the first time.

When the leading detectable portion reaches the second detector 47 positioned at the position 47*b* in FIG. 6, the detectable portion is detected, whereby a relay R13 is energized and accordingly the "*a*" contact R13al is turned on to self-retain the relay R13, while the "*a*" contacts R13a2 through R13a5 are also turned on and the "*b*" contact R13b is turned off. Turning off of the "*b*" contact R13b causes the magnet switch MF to be turned off, thereby to stop the forward driving of the machine. Turning on of the "*a*" contact R13a4 of the relay R13 causes a relay m(FIG. 11) for forward driving the drive motor 59M for the stoppers 55 and 56 (FIG. 7) to be energized, whereby the motor 59M is positively driven, with the result that the material is pulled away from the guide rolls 13 and 13' by means of the stoppers 55 and 56. If and when the stoppers 55 and 56 are rotated to reach a predetermined position, a limit switch LS3 is turned off and a limit switch LS3' is turned on, whereby the relay *m* is deenergized to deenergize the motor 59M, and a relay R15 is energized, respectively.

Energization of the relay R15 causes the "*a*" contact R15a to be turned on, whereby a relay A is energized and thus the "*a*" contacts Aa1 through Aa6 are turned on. Turning on of the "*a*" contact Aa4 of the relay A causes the magnet switch MF to be energized (FIG. 4A), thereby to drive the motor 8 (FIG. 1) in the forward direction.

If and when the trailing detectable portion 41' of the leader material 40 reaches the first detector 47' in FIG. 6, the trailing detectable portion 41' is detected by the detector 47', whereby a relay R10 is energized and thus the "*a*" contact R10a1 is turned on to self-retain the relay R10 and other "*a*" contacts R10a2 through R10a4 are also turned on. Since the "*a*" contact R13a3 of the relay R13, the "*a*" contact Aa3 of the relay A and the "*a*" contact MFa8 of the magnet switch MF have been turned on, turning on of the "*a*" contact R10a3 of the relay R10 causes a relay C to be energized. Since the relay C is energized, the *37 a*" contact Ca1 of the relay C is turned on to self-retain the relay C and the "*a*" contact Ca2 of the relay C is also turned on, while the "*b*" contact Cb of the relay C is turned off, thereby to deenergize the magnet switch MF to discontinue the forward driving of the machine. Thus correction of the first loop length is completed.

Turning on of the "*a*" contact Ca2 of the relay causes a relay *m'*(FIG. 11) for backward driving the motor 59M (FIG. 7) for driving the stoppers 55 and 56 to be energized, whereby the motor 59M is backward driven and thus the material is returend to the original state. Energization of the relay *m'* causes the "*a*" contact *m'a* of the relay *m'* to be turned on, thereby to self-retain the relay *m'*. On the other hand, the limit switch LS3 is turned on and the limit switch LS3' is turned off.

If and when the stoppers are returned to the original position, the limit switch LS4 is closed and accordingly a relay R14 is energized. Since energization of the relay R14 causes the "*a*" contact R14a2 of the relay R14 to be closed and the "*a*" contact Aa of the relay A has been closed, a relay R16 is energized and accordingly the "*b*" contact R16b of the relay R16 is turned off, whereby the loop length correcting circuit shown in FIG. 11 is reset. On the other hand, energization of the relay R14 causes the "*b*" contact R14b to be turned off, whereby the relay *m'* is deenergized and accordingly backward driving of the motor 59M is stopped.

Next a push button PB15 (FIG. 11) for a sensor moving circuit is depressed, so that a relay M is energized and thus the "*a*" contact Ma of the relay M is closed to self-retain the relay M. The motor 49M (FIG. 8) is adapted to be energized by energization of the relay M. As a result, the carriage 50 and thus the detectors 47 and 47' are moved until the detectors 47 and 47' come to the positions 47*c* and 47*b*, respectively (FIG. 6), when the limit switch LS1 is turned off and accordingly the relay M is deenergized, with the result that the motor 59M (FIG. 7) is stopped and accordingly the carriage 50 and thus the detectors 47 and 47' are positioned to the abovementioned predetermined positions.

Now a push buttom PB6 (FIG. 4A) is depressed for the purpose of correcting the second loop length this time. As a result, the magnet switch MF is energized and accordingly the motor 8 (FIG. 1) is energized to be forward driven. Since it was assumed previously that the second loop length is longer than the predetermined unit length of the leader material 40, this time the trailing detectable portion 41' of the leader material 40 comes to first reach the first detector 47' (FIG. 8), whereby the first detector 47' is turned on and accordingly the relay R10 is energized. The motor 8 (FIG. 1) is kept forward driven, however. If and when the leading detectable portion 41 of the leader material 40 comes to reach the second detector 47 (FIG. 8), the relay R13 is energized and accordingly the "*b*" contact R13b of the relay R13 is turned off, whereby the magnet switch MF is deenergized (FIG. 4A) and accordingly the motor 8 (FIG. 1) is stopped from forward driving. Energization of the relay R13 causes the "*a*" contact R13a4 to be turned on (FIG. 11), whereby the relay *m* is energized and the stoppers 55 and 56 are rotated, as fully described previously, thereby to urge the material away from the guide rolls 13 and 13'. If and when the stoppers 55 and 56 come to reach the predetermined position, the limit switch LS3 is turned off and the limit switch LS3' is turned on, as fully described previously, whereby the relay R15 is energized to close the "*a*" contact R15a thereof, which energizes the relay A, as described previously. Since the relays R10, R13 and A have thus been energized and accordingly the "*a*" contacts R10a4, R13a5 and Aa5 thereof, respectively, have been turned on, the magnet switch MR is energized, whereby the "*a*" contact MRa1 of the switch MR is turned on to self-retain the magnet switch MR, with the result that the motor 8 (FIG. 1) is backward driven. The "*a*" contacts MRa7 and MRa8 of the magnet switch MR are also closed.

During the backward driving of the motor 8 (FIG. 1), the trailing detectable portion 41' of the leader material 40 reaches the position of the first detector 47' (FIG. 6), when the detector 47' is closed and accordingly the relay R11 is energized through the closed "*a*" contact MRa7 of the magnet switch MR, thereby to close the "*a*" contact R11a1 of the relay R11.

Since the "*a*" contacts R13a2, R10a2, Aa2, MRa8 and R11a1 are all closed, the relay B is energized and accordingly the "*a*" contact Ba1 thereof is closed to self-retain the relay B. Energization of the relay B causes the "*b*" contact Bb thereof to be turned off, thereby to discontinue the backward driving of the motor 8 (FIG. 1), with the result that correction of the second loop length is completed. Energization of the relay B also causes the "*a*" Ba2 to be closed, whereby the relay *m'* is energized, thereby to backward drive the motor 57M for the stoppers 55 and 56. Thereafter the same operation as previously described is effected.

The above described operation is repeated thereafter for the remaining loop portions, thereby the perform the loop length correction throughout the material. After correction of the loop length of all loop portions is completed, a push button PB13 is depressed to be opened, whereby the relay R9 is deenergized and the "*a*" contact R9a2 is opened, with the result that the FIG. 11 circuit is disconnected.

While the correction of the loop lengths in the embodiment shown has been described as performed when the endless material to be processed is moved in the forward direction, it may be performed when said material is moved in the backward direction. Although the embodiment shown uses two detectable portions, alternatively three or more may be used, in which case it becomes possible to decide whether a loop length or lengths on one or the other or both sides of the leader cloth of a prescribed loop length being corrected are longer or shorter than the prescribed length. In the above explanation, the material to be processed by the present appartus has been described as a continuously connected textile fabric. However, the words "textile fabric" should not be taken in a limited sense but in a broad sense. Accordingly, it is intended that the words "textile fabric" as used herein include woven and knitted fabrics such as cloth, laces and knitwork, and braids and felt.

A first advantage of the embodiment shown resides in the fact that the squeeze roll assembly is reversibly rotatably disposed above and substantially centrally of the processing chamber while the guide rolls are also reversibly rotatably disposed on opposite sides of said squeeze roll assembly and that a continuously connected textile fabric is spirally set from one end side to the other end side of the processing chamber and is caused to travel alternately forwardly and backwardly as said squeeze roll assembly is rotated in such a manner that the forward travelling amount is greater than the backward travelling amount while repeating impregnation with processing liquid and subsequent squeeze many times. Therfore, according to the present invention, it is possible to apply an effective treatment through a smaller number of steps.

Another advantage of the embodiment of the invention resides in the fact that the guide rolls are disposed above the level of the nip point of the squeeze roll assembly and during the forward or backward rotation of the squeeze roll assembly one of the guide rolls which is disposed on the withdrawing side is positively rotated at such a rate that its surface speed is greater than that of the squeeze roll assembly while leaving the other guide roll to be negatively rotated. As a result of this arrangement, the twining of the material around the squeeze roll assembly during processing can be completely prevented and hence there is no possibility of the material being broken, thus assuring a stabilized quality. Further, continuous processing can be effected at very small cost of equipment.

A further aspect of the embodiment shown is described in the following. In the embodiment shown, storage chambers are provided in the textile fabric introducing and delivering sections of the processing chamber, each of said storage chambers having stored therein at least an amount of textile fabric corresponding to the forward travelling amount, the storage chamber on the inlet side being preceded by a preparatory immersion bath in which the textile fabric leading to the inlet side storage chamber is wetted in advance, and the textile fabric introduced into the inlet side storage chamber is prevented from being delivered in the backward direction from the inlet side storage chamber but the processed textile is gradually delivered from the outlet side storage chamber without regard to the forward and backward travel. Accordingly, the following undesirable situation can be avoided: In such reversible-feed type apparatus, it is necessary to provide pilers on the inlet and outlet sides of the washing bath for storing a material to be processed. The conventional pilers, however, only store a material to be processed which is in a dry state. For example, when a material to be processed is to be forwardly moved, such material which is in a dry state is put in from the pilers disposed on the inlet side, and immediately after it is immersed, it is set around the squeeze roll assembly. Therefore, the extent of impregnation of the material extremely differs between the initial and terminal end sides of the squeeze roll assembly and hence the tension in the material moving upwardly to the nip point extremely varies from place to place and the amounts of slip of the material at the individual nip points also extremely differ. As a result, the variations in the loop lengths of the material spirally set around the squeeze roll assembly are increased, making uniform treatment impossible and tending to cause various troubles to the material, such as damage, longitudinal stretch or elongation and breakage. If, for example, the forward and backward travelling amounts of the material are 100m and 80m, respectively, then a length of dry material measuring 20m is put into the washing bath disposed on the inlet side when the material forwardly travels, and this material portion quickly absorbs the washing liquid therearound, causing the movement of the washing liquid from other regions toward that region to make up for the consumed amount, which, in turn, causes a more pronounced zigzag movement of the material, and owing to the difference in the position at which the material upwardly moves, there are variations in the tension in the material leading to the individual nip points. During the backward travel, since the material after immersion is put into the outlet side of the washing bath, the amount of variation in tension is relatively small as compared with that produced during the forward travel. However, the processing conditions differ extremely between the forward and backward travels, which has been a factor responsible for making uniform treatment impossible. Further, the increased amount of washing liquid being taken out of the washing bath during the forward or backward travel results in a lack of stability of the liquid level. A further disadvantage is that there is the danger of causing a great loss of washing liquid. The embodiment shown has eliminated such disadvantages.

A further aspect of the embodiment shown is described in the following. According to the embodiment shown, a textile fabric for loop length correction having detectable portions attached thereto with a predetermined spacing therebetween is prepared, and when necessary, the textile fabric being processed is severed at the introduction and delivery sides of the processing chamber and the ends of the severed textile fabric are connected to the ends of said loop length correcting textile fabric to provide an endless form, while detectors are disposed in the path of travel of the endless textile fabric for detecting the detectable portions attached to said loop length correcting textile fabric and stoppers are provided for stopping the travel of a desired portion of the textile fabric upon detection of said detectable portions, whereby the individual loop lengths are corrected while the endless textile fabric is travelling through the processing apparatus. In this way, the loop length correction can be effected simply, easily and accurately and without requiring any labor and that in a short time.

In the foregoing description, the embodiment of the present invention was described as comprising the carriage 50 provided above the squeeze roll assembly for movement thereof in the direction of the axes of the squeeze roll assembly and the guide rolls so as to be positioned at the respective loop length portions such that detectors 47 and 47' may be faced to the adjacent two loop length portions while the stoppers 55 and 56 provided on the carriage 50 may also be faced to the loop length portions from above the guide rolls 13' and 13 when the carriage is positioned at the respective loop length portions while it is driven in the direction of the axes of the squeeze roll assembly 7 and the guide rolls 13' and 13. Alternatively, however, a plurality of detectors may be provided individually for each of the respective loop length portions and a selecting apparatus may be provided which is responsive to the positioning of the carriage 50 for selectively enabling only two adjacent relevant detectors out of said plurality of detectors, whereby the above described detectors 47 and 47' may be replaced. By way of a further alternative, a plurality of stoppers may be provided individually for each of the respective loop length portions and a selecting apparatus may be provided which is responsive to the positioning of the carriage 50 for selectively enabling only two adjacent relevant stoppers out of said plurality of stoppers whereby the above described stoppers 55 and 56 may be replaced. By way of still a further alternative, a plurality of detectors and a plurality of stoppers are individually provided for each of the respective loop length portions and a selecting apparatus may be also be provided which successively and selectively enables two adjacent detectors and a relevant stopper, whereby the movable carriage 50 provided with a pair of detectors and a pair of stoppers may be replaced.

It would further be possible for those skilled in the art to make many changes and modifications of the present invention without departing from the spirit and scope of the present invention. Therefore, it is intended that the true scope of the present invention is covered only by the appended claims.

What is claimed is:

1. An apparatus for successively processing a continuous textile fabric traveling along a predetermined feed path, said apparatus comprising:

means for feeding said continuous textile fabric along said path, squeeze roll means having one end and another end defining an axial direction thereof, said squeeze roll means being disposed in said path for squeezing and nipping said continuous textile fabric at a plurality of nip points when said textile fabric is passed therethrough, first and second guide roll means provided at respective sides of said squeeze roll means in parallel with and equally spaced apart from said squeeze roll means and having one end and another end defining an axial direction parallel to said axial direction of said squeeze roll means for guiding said continous textile fabric fed to and from said squeeze roll means, said continuous textile fabric being successively and spirally set around said squeeze roll and said guide roll means from said one end to said other end thereof, respectively, said plurality of nip points of said continuous textile fabric as nipped by said squeeze roll means being grouped into pairs of adjacent nip points, each pair of said adjacent nip points defining a corresponding loop-like portion of said continuous textile fabric, means provided along said feed path for processing said loop like portions of said continuous textile fabric, first feed control means connected to said feeding means for enabling said feeding means to feed said continuous textile fabric in a first direction, and second feed control means connected to said feeding means for enabling said feeding means to feed said continuous textile fabric in a second direction, wherein said first and said second feed control means include respective means for setting said amount of travel in said first and second directions, respectively, and wherein the amount of travel of said continuous textile fabric along said feed path in said first direction of the feeding operation is set to be larger than that in said second direction of the feedingoperation, so that said continuous textile fabric is advanced in said first direction by a predetermined amount as a result of a predetermined number of said first and second directions of reciprocating feeding operations, said apparatus further comprising means operatively associated with said first and second feed control means for alternately enabling said first and said second feed control means, respectively, wherein said guide roll means is provided above the nip points of said continuous textile fabric nipped by said squeeze roll means, said squeeze roll means having a withdrawing side from which said textile fabric is withdrawn, and the circumferential speed of said guide roll means at the withdrawing side of said squeeze roll means is adapted to be larger than the circumferential speed of said squeeze roll means.

2. An apparatus in accordance with claim 1, wherein said alternate enabling means comprises means for determining the amount of said continuous textile fabric fed by said feeding means in said first direction.

3. An apparatus in accordance with claim 2 wherein said feeding means comprises feeding rollers.

4. An apparatus in accordance with claim 3, wherein said determining means comprises means for counting the number of rotations of said feeding rollers.

5. An apparatus in accordance with claim 1, wherein said squeeze roll means has an introducing side to which said textile fabric is introduced, and wherein said guide roll means on the introducing side of said squeeze roll means is set in an idling state.

6. An apparatus for successively processing a continuous textile fabric traveling along a predetermined feed path, said apparatus comprising:

means for feeding said continuous textile fabric along said path, squeeze roll means having one end and another end defining an axial direction thereof, said squeeze roll means being disposed in said path for squeezing and nipping said continuous textile fabric at a plurality of nip points when said textile fabric is passed therethrough, first and second guide roll means provided at respective sides of said squeeze roll means in parallel with and equally spaced apart from said squeeze roll means and having one end and another end defining an axial direction parallel to said axial direction of said squeeze roll means for guiding said continuous textile fabric fed to and from said squeeze roll means, said continuous textile fabric being successively and spirally set around said squeeze roll and said guide roll means from said one end to said other end thereof, respectively, said plurality of nip points of said continuous textile fabric as nipped by said squeeze roll means being grouped into pairs of adjacent nip points, each pair of adjacent nip points defining a corresponding loop-like portion of said continuous textile fabric, means provided along said feed path for processing said loop like portions of said continuous textile fabric, first feed control means connected to said feeding means for enabling said feeding means to feed said continuous textile fabric in a first direction, and second feed control means connected to said feeding means for enabling said feeding means to feed said continuous textile fabric in a second direction, wherein said first and said second feed control means include respective means for setting said amount of travel in said first and second directions, respectively, and wherein the amount of travel of said continuous textile fabric along said feed path in said first direction of the feeding operation is set to be larger than that in said second direction of the feeding operation, so that said continuous textile fabric is advanced in said first direction by a predetermined amount as a result of a predetermined number of said first and second directions of reciprocating feeding operations, said apparatus further comprising means operatively associated with said first and second feed control means for alternately enabling said first and said second feed control means, respectively, said apparatus having an introducing and a withdrawing end to which and from which, respectively, said fabric is introduced and withdrawn, said apparatus further comprising auxiliary means provided at the introducing and withdrawing ends, respectively, for reserving portions of said continuous textile fabric at said introducing and withdrawing ends, respectively.

7. An apparatus in accordance with claim 6, having an introducing and a withdrawing end to which and from which, respectively, successive portions of said fabric are introduced and withdrawn, whereby said continuous textile fabric is formed in a large loop, whereby each successive portion of said continuous textile fabric as withdrawn from the withdrawing end of said apparatus is introduced to the introducing end of said apparatus, said apparatus further comprising means for guiding said each successive portion of said continuous textile fabric as withdrawn from the withdrawing end toward the introducing end.

8. An apparatus for successively processing a continuous textile fabric traveling along a predetermined feed path, said apparatus comprising:

means for feeding said continuous textile fabric along said path, squeeze roll means having one end and another end defining an axial direction thereof, said squeeze roll means being disposed in said path for squeezing and nipping said continuous textile fabric at a plurality of nip points when said textile fabric is passed therethrough, first and second guide roll means provided at respective sides of said squeeze roll means in parallel with and equally spaced apart from said squeeze roll means and having one end and another end defining an axial direction parallel to said axial direction of said squeeze roll means for guiding said continuous textile fabric fed to and from said squeeze roll means, said continuous textile fabric being successively and spirally set around said squeeze roll and said guide roll means from said one end to said other end thereof, respectively, said plurality of nip points of said continuous textile fabric as nipped by said squeeze roll means being grouped into pairs of adjacent nip points, each pair of adjacent nip points defining a corresponding loop-like portion of said continuous textile fabric, means provided along said feed path for processing said loop like portions of said continuous textile fabric, first feed control means connected to said feeding means for enabling said feeding means to feed said continuous textile fabric in a first direction, and second feed control means connected to said feeding means for enabling said feeding means to feed said continuous textile fabric in a second direction, wherein said first and said second feed control means include respective means for setting said amount of travel in said first and second directions, respectively, and wherein the amount of travel of said continuous textile fabric along said feed path in said first direction of the feeding operation is set to be larger than that in said second direction of the feeding operation, so that said continuous textile fabric is advanced in said first direction by a predetermined amount as a result of a predetermined number of said first and second directions of reciprocating feeding operations, said apparatus further comprising means operatively associated with said first and second feed control means for alternately enabling said first and said second feed control means, respectively, said apparatus having an introducing and a withdrawing end from which, respectively, successive portions of said fabric are introduced and withdrawn, whereby said continuous textile fabric is formed in a large loop, whereby each successive portion of said continuous textile fabric is withdrawn from the withdrawing end of said apparatus is introduced to the introducing end of said apparatus, said apparatus further comprising means for guiding said each successive portion of said continuous textile fabric as withdrawn from the withdrawing end toward the introducing end, wherein said continuous textile fabric of a large loop shape comprises at least two detectable portions provided spaced apart at a predetermined distance adapted for a reference length of said loop like portions, and which apparatus further comprises a plurality of detecting means disposed in successively displaced portions along said feeding path for detecting said detectable portions of said continuous textile fabric, and means responsive to said detecting means for unifying the lengths of the respective loop like portions of said continuous textile fabric between adjacent two nip points of said continuous textile fabric as nipped by said squeeze roll means.

9. An apparatus in accordance with claim 8, wherein said detecting means comprises at least first and second detectors provided along first and second adjacent ones of said plurality of loop like portions of said continuous textile fabric, and said length unifying means comprises first stopping means responsive to one of said first and second detectors for stopping the travel of one of said two adjacent loop like portions, and second stopping means responsive to the other of said first and second detectors for stopping the other portion of said continuous textile fabric.

10. An apparatus in accordance with claim 9, wherein said first and second stopping means comprise a plurality of stoppers, one provided individually for each of said loop like portions, and said detecting means comprises a plurality of detectors provided individually for each of said loop like portions, and which further comprises means for successively selecting associated ones of said plurality of stoppers and detectors.

11. An apparatus in accordance with claim 9, wherein said first and second stopping means comprise means responsive to said detecting means for separating a portion of said continuous textile fabric from said guide roll means.

12. An apparatus for successively processing a continuous textile fabric traveling along a predetermined feed path, said apparatus comprising:

means for feeding said continuous textile fabric along said path, squeeze roll means having one end and another end defining an axial direction thereof, said squeeze roll means being disposed in said path for squeezing and nipping said continuous textile fabric at a plurality of nip points when said textile fabric is passed therethrough, first and second guide roll means provided at respective sides of said squeeze roll means in parallel with and equally spaced apart from said squeeze roll means and having one end and another end defining an axial direction parallel to said axial direction of said squeeze roll means for guiding said continuous textile fabric fed to and from said squeeze roll means, said continuous textile fabric being successively and spirally set around said squeeze roll and said guide roll means from said one end to said other end thereof, respectively, said plurality of nip points of said continuous textile fabric as nipped by said squeeze roll means being grouped into pairs of adjacent nip points, each pair of adjacent nip points defining a corresponding loop-like portion of said continuous textile fabric means provided along said feed path for processing said loop like portions of said continuous textile fabric, first feed control means connected to said feeding means for enabling said feeding means to feed said continuous textile fabric in a first direction, and second feed control means connected to said feeding means for enabling said feeding means to feed said continuous textile fabric in a second direction, wherein said first and said second feed control means include respective means for setting said amount of travel in said first and second directions, respectively, and wherein the amount of travel of said continuous textile fabric along said feed path in said first direction of the feeding operation is set to be larger than that in said second direction of the feeding operation, so that said continuous textile fabric is advanced in said first direction by a predetermined amount as a result of a predetermined number of said first and second directions of reciprocating feeding operations, said apparatus further comprising means operatively associated with said first and second feed control means for alternately enabling said first and said second feed control means, respectively, said apparatus having an introducing and a withdrawing end from which, respectively, successive portions of said fabric are introduced and withdrawn, whereby said continuous textile fabric is formed in a large loop, whereby each successive portion of said continuous textile fabric as withdrawn from the withdrawing end of said apparatus is introduced to the introducing end of said apparatus, said apparatus further comprising means for guiding said each successive portion of said continuous textile fabric as withdrawn from the withdrawing end toward the introducing end, said continuous textile fabric of a large loop shape comprises at least two detectable portions provided spaced apart at a predetermined distance adapted for a reference length of said loop like portions, and which apparatus further comprises a plurality of detecting means disposed in successively displaced portions along said feeding path for detecting said detectable portions of said continuous textile fabric, and means responsive to said detecting means for unifying the lengths of the respective loop like portions of said continuous textile fabric between adjacent two nip points of said continuous textile fabric as nipped by said squeeze roll means, wherein said detecting means comprises at least first and second detectors provided along first and second adjacent ones of said plurality of loop like portions of said continuous textile fabric, and said length unifying means comprises first stopping means responsive to one of said first and second detectors for stopping the travel of one of said two adjacent loop like portions, and second stopping means responsive to the other of said first and second detectors for stopping the other portion of said continuous textile fabric, which apparatus further comprises a carriage provided for movement thereof in the axial direction of said squeeze and said guide roll means so as to be positioned at each of said loop like portions, and wherein said detecting means is provided on said carriage so as to be positioned along said loop like portions of said continuous textile fabric when said carriage is positioned at each of said loop like portions of sid continuous textile fabric.

13. An apparatus in accordance with claim 12, wherein said first and second stopping means comprise a pluraity of stoppers, one provided individually for each of said loop like portions of said continuous textile fabric.

14. An apparatus in accordance with claim 12, wherein said first and second stopping means include a plurality of further stoppers provided on said carriage , one positioned at each of the respective loop like portions of said continuous textile fabric.

15. An apparatus for successively processing a continuous textile fabric traveling along a predetermined feed path, said apparatus comprising:

means for feeding said continuous textile fabric along said path, squeeze roll means having one end and another end defining an axial direction thereof, said squeeze roll means being disposed in said path for squeezing and nipping said continuous textile fabric at a plurality of nip points when said textile fabric is passed therethrough, first and second guide roll means provided at respective sides of said squeeze roll means in parallel with and equally spaced apart from said squeeze roll means and having one end and another end defining an axial direction parallel to said axial direction of said squeeze roll means for guiding said continuous textile fabric fed to and from said squeeze roll means, said continuous textile fabric being successively and spirally set around said squeeze roll and said guide roll means from said one end to said other end thereof, respectively, said plurality of nip points of said continuous textile fabric as nipped by said squeeze roll means being grouped into pairs of adjacent nip points, each pair of adjacent nip points defining a corresponding loop-like portion of said continuous textile fabric, means provided along said feed path for processing said loop like portions of said continuous textile fabric, first feed control means connected to said feeding means for enabling said feeding means to feed said continuous textile fabric in a first direction, and second feed control means connected to said feeding means for enabling said feeding means to feed said continuous textile fabric in a second direction, wherein said first and said second feed control means include respective means for setting said amount of travel in said first and second directions, respectively, and wherein the amount of travel of said continuous textile fabric along said feed path in said first direction of the feeding operation is set to be larger than that in said second direction of the feeding operation, so that said continuous textile fabric is advanced in said first direction by a predetermined amount as a result of a predetermined number of said first and second directions of reciprocating feeding operations, said apparatus further comprising means operatively associated with said first and second feed control means for alternately enabling said first and said second feed control means, respectively, said apparatus having an introducing and a withdrawing end from which, respectively, successive portions of said fabric are introduced and withdrawn, whereby said continuous textile fabric is formed in a large loop, whereby each successive portion of said continuous textile fabric as withdrawn from the withdrawing end of said apparatus is introduced to the introducing end of said apparatus, said apparatus further comprisng means for guiding said each successive portion of said continuous textile fabric as withdrawn from the withdrawing end toward the introducing end, said continuous textile fabric of a large loop shape comprises at least two detectable portions provided spaced apart at a predetermined distance adapted for a reference length of said loop like portions, and which apparatus further comprises a plurality of detecting means disposed in successively displaced portions along said feeding path for detecting said detectable portions of said continuous textile fabric, and means responsive to said detecting means for unifying the lengths of the respective loop like portions of said continuous textile fabric between adjacent two nip points of said continuous textile fabric as nipped by said squeeze roll means, wherein said detecting means comprises at least first and second detectors provided along first and second adjacent ones of said plurality of loop like portions of said continuous textile fabric, and said length unifying means comprises first stopping means responsive to one of said first and second detectors for stopping the travel of one of said two adjacent loop like portions, and second stopping means responsive to the other of said first and second detectors for stopping the other portion of said continuour textile fabric, which apparatus further comprises a carriage provided for movement thereof in the axial direction of said squeeze roll means so as to be positioned at each of said loop like portions, and wherein said first and second stopping means include a plurality of further stoppers provided on said carriage and positioned along said loop like portions of said continuous textile fabric when said carriage is positioned at each of said loop like portions of said continuous textile fabric.

16. An apparatus in accordance with claim 15, in which said detecting means comprises a plurality of detectors, one provided individually for each of said loop like portions of said continuous textile fabric.

17. An apparatus in accordance with claim 15, wherein said first and second stopping means comprise a plurality of stoppers, one provided individually for each of said loop like portions, and said detecting means comprises a plurality of detectors provided individually for each of said loop like portions, and which further comprises menas for successively selecting associated ones of said plurality of stoppers and detectors.

18. An apparatus in accordance with claim 15, wherein said first and second stopping means comprise means responsive to said detecting means for separating a portion of said continuous textile fabric from said guide roll means.

19. A continuous processing system for processng a successively connected textile fabric traveling along a predetermined path, comprising in combination:

first and second guide means for guiding said textile fabric in either one of a forward and reverse direction along said predetermined path;

processing chamber means disposed along said predetermined path for processing said fabric passing therethrough;

squeezing means disposed between said first and second guide means and adjacent to said processing chamber means and in said predetermined path for squeezing said fabric passing therethrough, said first and second guide means being equally spaced apart from said squeezing means; and conveying means operatively associated with said squeezing means for conveying said fabric a given distance in said forward direction during an initial period of a given cycle, and for conveying said fabric a second distance, less than said given distance, in said reverse direction during a subsequent period of said given cycle, whereby to introduce succcessive portions of said fabric to said processing chamber means and to said squeezing means, wherein said squeezing means includes squeeze roller means having one end and another end defining an axial direction thereof, said squeeze roller means being disposed in said path for squeezing and nipping said continuous textile fabric in at least one nip point when said textile fabric is passed therethrough, wherein said conveying means includes motor means connected to said squeeze roller means for driving said squeeze roller means whereby to convey said fabric alternately in said forward and reverse directions, wherein said guiding means includes a pair of guide rollers, one on a forward direction side of said squeezing means and another on a reverse direction side of said squeezing means in said predetermined path, and wherein said motor means is connected to each of said pair of guide rollers for driving said guide roller on said forward direction side during said initial period of said given cycle, and for driving said guide roller on said reverse direction side during said subsequent period of said given cycle.

20. A continuous processing system for processing a successively connected textile fabric traveling along a predetermined path, comprising in combination:

first and second guide meas for guiding said textile fabric in either one of a forward and reverse direction along said predetermined path;

processing chamber means disposed along said predetermined path for processing said fabric passng therethrough;

squeezing means disposed between said first and second guide means and adjacent to said processing chamber means and in said predetermined path for squeezing said fabric passing therethrough, said first and second guide means being equally spaced apart from said squeezing means; and conveying means operatively associated with said squeezing means for conveying said fabric a given distance in said forward direction during an initial period of a given cycle, and for conveying said fabric a second distance, less than said given distance, in said reverse direction during a subsequent period of said given cycle, whereby to introduce successive portions of said fabric to said processing chamber means and to said squeezing means, wherein said squeezing means includes squeeze roller means having one end and another end defining an axial direction thereof, said squeeze roller means being disposed in said path for squeezing and nipping said continuous textile fabric in at least one nip point when said textile fabric is passed therethrough, wherein said conveying means includes motor means connected to said squeeze roller means for driving said squeeze roller means whereby to convey said fabric alternately in said forward and reverse directions, wherein said guiding means includes a pair of guide rollers, one on a forward direction side of said squeezing means and another on a reverse direction side of said squeezing means in said predetermined path, and wherein said motor means is connected to each of said pair of guide rollers for driving said guide roller on said forward direction side during said initial period of said given cycle, and for driving said guide roller on said reverse direction side during said subsequent period of said given cycle, wherein during said initial period said guide roller on said forward direction side is driven with a speed greater than the speed with which said squeeze roller means is driven, and wherein during said subsequent period said guide roller on said reverse direction side is driven with a speed greater than the speed with which said squeeze roller means is driven, whereby sagging of said fabric between said respective guide rollers and said squeeze roller means is minimized.

21. A system in accordance with claim 20 said at least one nip point comprises a plurality of nip points of said continuous textile fabric as nipped by said squeeze roller means, said plurality of nip points being grouped into pairs of adjacent nip points, each pair of adjacent nip points defining a corresponding loop like portion of said continuous textile fabric, said corresponding loop like portions having respective loop lengths which vary from a desired loop length, said system including loop length correcting means for successively correcting said respective loop lengths to cause them to coincide with said desired loop length.

22. A continuous processing system for processing a successively connected textile fabric traveling along a predetermined path, comprising in combination:

first and second guide means for guiding said textile fabric in either one of a forward and reverse direction along said predetermined path;

processing chamber means disposed along said predetermined path for processing said fabric passing therethrough;

squeezing means disposed between said first and second guide means and adjacent to said processing chamber means and in said predetermined path for squeezing said fabric passing therethrough, said first and second guide means being equally spaced apart from said squeezing means; and conveying means operatively associated with said squeezing means for conveying said fabric a given distance in said forward direction during an initial period of a given cycle, and for conveying said fabric a second distance, less than said given distance, in said reverse direction during a subsequent period of said given cycle, whereby to introduce successive portions of said fabric to said processing chamber means and to said squeezing means, wherein said squeezing means includes squeeze roller means having one end and another end defining an axial direction thereof, said squeeze roller means being disposed in said path for squeezing and nipping said continuous textile fabric in a plurality of nip point when said textile fabric is passed therethrough, said plurality of nip points of said continuous textile fabric as nipped by said squeeze roller means being grouped into pairs of adjacent nip points, each pair of adjacent nip points defining a corresponding loop like portion of said continuous textile fabric, said corresponding loop like portions having respective loop lengths which vary from a desire loop length, said system including loop length correcting means for successively correcting said respective loop lengths to cause them to coincide with said desired loop length, wherein said fabric is formed in a large loop and includes at least two detectable portions provided spaced apart at a predetermined distance adapted for a reference length of said loop like portions, said loop length correcting means including a plurality of detecting means disposed in successively displaced portions along said large loop for detecting said detectable portions of said continuous textile fabric, and means responsive to said detecting means for unifying the lengths of the respective loop like portions of said continuous textile fabric between each pair of adjacent nip points of said continuous textile fabric as nipped by said squeeze roll means.

23. A system in accordance with claim 22 wherein said detecting means comprises at least first and second detectors provided along first and second adjacent ones of said plurality of loop like portions of said continuous textile fabric, and said length unifying means comprises first means responsive to one of said first and second detectors for stopping the travel of one of said two adjacent loop like portions, and second means responsive to the other of said first and second detectors for stopping the other portion of said continuous textile fabric.

24. A continuous processing system for processing a successively connected textile fabric traveling along a predetermined path, comprising in combination:

first and second guide means for guiding said textile fabric in either one of a forward and reverse direction along said predetermined path;

processing chamber means disposed along said predetermined path for processing said fabric passing therethrough;

squeezing means disposed between said first and second guide means and adjacent to said processing chamber means and in said predetermined path for squeezing said fabric passing therethrough, said first and second guide means being equally spaced apart from said squeezing means; and conveying means operatively associated with said squeezing means for conveying said fabric a given distance in said forward direction during an initial period of a given cycle, and for conveying said fabric a second distance, less than said given distance, in said reverse direction during a subsequent period of said given cycle, whereby to introduce sucessive portions of said fabric to said processing chamber means and to said squeezing means, wherein said squeezing means includes squeeze roller means having one end and another end defining an axial direction thereof, said squeeze roller means being disposed in said path for squeezing and nipping said continuous textile fabric in a plurality of nip points when said textile fabric is passed therethrough, said plurality of nip points of said continuous textile fabric as nipped by said squeeze roller means being grouped into pairs of adjacent nip points, each pair of adjacent nip points defining a corresponding loop like portion of said continuous textile fabric, said corresponding loop like portions having respective loop lengths which vary from a desired loop length, said system including loop length correcting means for successively correcting said respective loop lengths to cause them to coincide with said desired loop length, wherein said fabric is formed in a large loop and includes at least two detectable portions provided spaced apart at a predetermined distance adapted for a reference length of said loop like portions, said loop length correcting means including a plurality of detecting means disposed in successively displaced portions along said large loop for detecting said detectable portions of said continuous textile fabric, and means responsive to said detecting means for unifying the lengths of the respective loop like portions of said continuous textile fabric between each pair of adjacent nip points of said continuous textile fabric as nipped by said squeeze roll means, wherein said detecting means comprises at least first and second detectors provided along first and second adjacent ones of said plurality of loop like portions of said continuous textile fabric, and said length unifying means comprises first means responsive to one of said first and second detectors for stopping the travel of one of said two adjacent loop like portions, and second means responsive to the other of said first and second detectors for stopping the other portion of said continuous textile fabric, said system further comprising a carriage means for moving along and adjacent to said guide means and said squeezing means so as to be positioned at each of said loop like portions, said first and second detectors being positioned on said carriage so as to be adjacent to said loop like portions of said continuous textile fabric when said carriage is positioned at each of said loop like portions of said continuous textile fabric.

25. A system in accordance with claim 24 wherein said stopping means comprises a plurality of stoppers, one provided individually for each of said loop like portions of said continuous textile fabric.

26. A system in accordance with claim 25 wherein each one of said stoppers is positioned on said carriage so as to be adjacent to a corresponding one of the loop like portions of said continuous textile fabric.

27. A system in accordance with claim 24 wherein said guide means includes a pair of guide rollers, one on each side of said squeezing means in said predetermined path.

28. A system in accordance with claim 27 wherein said squeezing means has a forward direction side on which one of said guide rollers is disposed and a reverse direction side on which another of said guide rollers is disposed, and wherein said conveying means inludes driving means connected to said guide rollers for driving said guide roller on said forward direction side during said initial period of said given cycle, and for driving said guide roller on said reverse direction side during said subsequent period of said given cycle.

29. A system in accordance with claim 28 wherein said driving means includes motor means for providing a driving force to said guide rollers, first clutch means connected between said motor means and said guide roller on said reverse direction side for idling said guide roller on said reverse direction side during said initial period, and second clutch means connected between said motor means and said guide roller on said forward direction side for idling said guide roller on said forward direction side during said subsequent period.

30. A system in accordance with claim 19 wherein said apparatus has an introducing end where said continuous textile fabric is introduced, and a withdrawing end where said continuous textile fabric is withdrawn, and wherein said guide means includes a first guide disposed at said withdrawing end of said system and a second guide disposed at said introducing end of said system, said system including respective reserving means provided at each of said withdrawing and introducing ends for reserving respective portions of said fabric at said respective withdrawing and introducing ends.

31. A system in accordance with claim 30 wherein said reserving means at said introducing end includes pre-immersion bath means for wetting said fabric prior to its being processed by said processing chamber means.

32. A continuous processing system for processing a successively connected textile fabric traveling along a predetermined path, comprising in combination:

first feeder means comprising first rotatable guide rollers for feeding said fabric in a forward direction along said predetermined path;

second feeder means comprising second rotatable guide rollers for feeding said fabric in a reverse direction along said predetermined path;

processing chamber means disposed along said predetermined path for processing said fabric passing therethrough;

squeezing means disposed between said first and second feeder means and adjacent to said processing chamber means and in said predetermined path for squeezing said fabric passing therethrough, said first and second feeder means being spaced equally apart from said squeezing means; and control circuit means operatively associated with said first and second feeder means for actuating the first rotatable guide rollers and idling the second rotatable guide rollers during a first cycle and for actuating the second rotatable guide rollers and idling the first rotatable guide rollers during a second cycle following said first cycle, wherein said control circuit means includes determining means operatively associated with each of said respective rotatable guide rollers for counting the number of rotations of said respective rotatable guide rollers, said system having a withdrawing end and an introducing end, respectively, from which and to which said textile fabric is respectively withdrawn and introduced, wherein said first feeder means is disposed at said withdrawing end of said system and said second feeder means is disposed at said introducing end of said system, respective reserving means being provided at each of said withdrawing and introducing ends for reserving respective portions of said fabric at said respective withdrawing and introducing ends.

33. A system in accordance with claim 32 wherein said reserving means at said introducing end includes pre-immersion bath means for wetting said fabric prior to its being processed by said processing chamber means.

34. An apparatus in accordance with claim 1, having an introducing and a withdrawing end to which and from which, respectively, successive portions of said fabric are introduced and withdrawn, whereby said continuous textile fabric is formed in a large loop, whereby each successive portion of said continuous textile fabric as withdrawn from the withdrawing end of said apparatus is introduced to the introducing end of said apparatus, said apparatus further comprising means for guiding said each successive portion of said continuous textile fabric as withdrawn from the withdrawing end toward the introducing end.

35. An apparatus in accordance with claim 12, wherein said first and second stopping means comprises a plurality of stoppers, one provided individually for each of said loop like portions, and said detecting means comprises a plurality of detectors provided individually for each of said loop like portions, and which further comprises means for successively selecting associated ones of said plurality of stoppers and detectors.

36. An apparatus in accordance with claim 12, wherein said first and second stopping means comprise means responsive to said detecting means for separating a portion of said continuous textile fabric from said guide roll means.

37. A system in accordance with claim 19, wherein said at least one nip point comprises a plurality of nip points of said continuous textile fabric as nipped by said squeeze roller means, said plurality of nip points being grouped into pairs of adjacent nip points, each pair of adjacent nip points defining a corresponding loop like portion of said continuous textile fabric, said corresponding loop like portions having respective loop lengths which vary from a desired loop length, said system including loop length correcting means for successively correcting said respective loop lengths to cause them to coincide with said desired loop length.

38. A system in accordance with claim 19, including first clutch means connected between said motor means and said guide roller on said reverse direction side for idling said guide roller on said reverse direction side during said initial period, and second clutch means connected between said motor means and said guide roller on said forward direction side for idling said guide roller on said forward direction side during said subsequent period.

39. A system in accordance with claim 20 wherein said driving means includes a motor, first clutch means connected between said motor and said guide roller on said reverse direction side for idling said guide roller on said reverse direction side during said initial period, and second clutch means connected between said motor and said guide roller on said forward direction side for idling said guide roller on said forward direction side during said subsequent period.

40. A system in accordance with claim 22 wherein said guide means includes a pair of guide rollers, one on each side of said squeezing means in said predetermined path.

41. A system in accordance with claim 40 wherein said squeezing means has a forward direction side on which one of said guide rollers is disposed and a reverse direction side on which another of said guide rollers is disposed, and wherein said conveying means includes driving means connected to said guide rollers for driving said guide roller on said forward direction side during said initial period of said given cycle, and for driving said guide roller on said reverse direction side during said subsequent period of said given cycle.

42. A apparatus in accordance with claim 41 wherein said driving means includes motor means for providing a driving force to said guide rollers, first clutch means connected between said motor means and said guide roller on said reverse direction side for idling said guide roller on said reverse direction side during said initial period, and second clutch means connected between said motor means and said guide roller on said forward direction side for idling said guide roller on said forward direction side during said subsequent period.

43. A system in accordance with claim 19 wherein said apparatus has an introducing end where said continuous textile fabric is introduced, and a withdrawing end where said continuous textile fabric is withdrawn, and wherein said guide means includes a first guide disposed at said withdrawing end of said system and a second guide disposed at said introducing end of said system, said system including respective reserving means provided at each of said withdrawing and introducing ends for reserving respective portions of said fabric at said respective withdrawing and introducing ends.

44. A system in accordance with claim 43 wherein said reserving means at said introducing end includes pre-immersion bath means for wetting said fabric prior to its being processed by said processing chamber means.

45. A system in accordance with claim 20 wherein said apparatus has an introducing end where said continuous textile fabric is introduced, and a withdrawing end where said continuous textile fabric is withdrawn, and wherein said guide means includes a first guide disposed at said withdrawing end of said system and a second guide disposed at said introducing end of said system, said system including respective reserving means provided at each of said withdrawing and introducing ends for reserving respective portions of said fabric at said respective withdrawing and introducing ends.

46. A system in accordance with claim 45 wherein said reserving means at said introducing end includes pre-immersion bath means for wetting said fabric prior to its being processed by said processing chamber means.

47. A system in accordance with claim 22 wherein said apparatus has an introducing end where said continuous textile fabric is introduced, and a withdrawing end where said continuous textile fabric is withdrawn, and wherein said guide means includes a first guide disposed at said withdrawing end of said system and a second guide disposed at said introducing end of said system, said system including respective reserving means provided at each of said withdrawing and introducing ends for reserving respective portions of said fabric at said respective withdrawing and introducing ends.

48. A system in accordance with claim 47 wherein said reserving means at said introducing end includes pre-immersion bath means for wetting said fabric prior to its being processed by said processing chamber means.

* * * * *

UNITED STATES PATENT AND TRADEMARK OFFICE

CERTIFICATE OF CORRECTION

PATENT NO. : 4,103,521

DATED : August 1, 1978

INVENTOR(S) : Yoshishige Tachibana

It is certified that error appears in the above-identified patent and that said Letters Patent are hereby corrected as shown below:

Column 4, line 34, delete "of" first occurrence.
Column 7, line 21, "detecing" should be --detecting--.
Column 7, line 38, "a" should be --"a"--.
Column 8, line 17, "b" should be --"b"--.
Column 9, line 5, delete "a" (second occurrence).
Column 9, line 18, "therby" should be --thereby--.
Column 9, line 66, "metalic" (both occurrences) should be --metallic--.
Column 12, line 20, "41'" should be --41--.
Column 13, line 44, "a" should be --"a"--.
Column 13, line 49, "to" (second occurrence) should be --the--.
Column 14, line 43, "37a"" should be --"a"--.
Column 14, line 54, "returend" should be --returned--.
Column 15, line 16, "buttom" should be --button--.
Column 16, line 5, "the" (second occurrence) should be --to--.
Column 16, line 44, "Therfore" should be --Therefore--.
Column 19, line 29, "feedingoperation" should be --feeding operation--.
Column 23, line 68, "sid" should be --said--.
Column 25, line 33, "continuour" should be --continuous--.

UNITED STATES PATENT AND TRADEMARK OFFICE

CERTIFICATE OF CORRECTION

PATENT NO. : 4,103,521

DATED : August 1, 1978

INVENTOR(S) : Yoshishige Tachibana

It is certified that error appears in the above-identified patent and that said Letters Patent are hereby corrected as shown below:

Column 25, line 56, "menas" should be --means--.
Column 26, line 44, "meas" should be --means--.
Column 26, line 48, "passng" should be --passing--.
Column 28, line 62, "sucessive" should be --successive--.
Column 29, line 65, "inludes" should be --includes--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*